US009113698B2

(12) United States Patent
Blain et al.

(10) Patent No.: US 9,113,698 B2
(45) Date of Patent: Aug. 25, 2015

(54) DRINK CONTAINERS AND CAP ASSEMBLIES

(71) Applicant: CamelBak Products, LLC, Petaluma, CA (US)

(72) Inventors: Christopher C. Blain, Sausalito, CA (US); Greg Caneer, Mill Valley, CA (US); Jeff Davies, Windsor, CA (US)

(73) Assignee: CamelBak Products, LLC, Petaluma, CA (US)

( * ) Notice: Subject to any disclaimer, the term of this patent is extended or adjusted under 35 U.S.C. 154(b) by 0 days.

(21) Appl. No.: 14/203,303

(22) Filed: Mar. 10, 2014

(65) Prior Publication Data

US 2014/0263476 A1 Sep. 18, 2014

Related U.S. Application Data

(60) Provisional application No. 61/788,811, filed on Mar. 15, 2013, provisional application No. 61/859,695, filed on Jul. 29, 2013.

(51) Int. Cl.
*A47G 19/22* (2006.01)
*A45F 3/18* (2006.01)

(52) U.S. Cl.
CPC ..... *A45F 3/18* (2013.01)

(58) Field of Classification Search
USPC ..... 220/711, 714, 715, 716, 717, 367.1, 220/254.1, 254.2, 254.3
See application file for complete search history.

(56) References Cited

U.S. PATENT DOCUMENTS

| | | | |
|---|---|---|---|
| RE15,225 | E | 11/1921 | Jarvis |
| 2,154,346 | A | 4/1939 | Mills |
| 2,447,870 | A | 8/1948 | Polcyn |
| 2,516,513 | A | 7/1950 | Gall, Jr. |
| 2,578,201 | A | 12/1951 | Nicorvo |
| 2,625,306 | A | 1/1953 | Murphy |

(Continued)

FOREIGN PATENT DOCUMENTS

| | | | |
|---|---|---|---|
| CA | 2710177 | A1 | 7/2009 |
| CN | 2603023 | Y | 2/2004 |

(Continued)

OTHER PUBLICATIONS

English-language abstract of Korea Patent Publication No. KR 10-1997-0005188, Oct. 15, 1999.

(Continued)

*Primary Examiner* — Steven A. Reynolds
*Assistant Examiner* — King M Chu
(74) *Attorney, Agent, or Firm* — DASCENZO Intellectual Property Law, P.C.

(57) ABSTRACT

Drink containers include a liquid container and a cap assembly removably coupled to the liquid container. Cap assemblies include a body that defines a drink outlet for dispensing drink liquid, and an operational assembly that is operatively coupled to the body and that has at least an open configuration permitting drink liquid to be dispensed and a closed configuration restricting drink liquid from being dispensed. In some embodiments, the operational assembly also has a cleaning configuration in which portions of the operational assembly are spaced away from the body of the cap assembly for cleaning. In some embodiments, the operational assembly is positioned predominantly on the exterior of the body of the cap assembly.

39 Claims, 14 Drawing Sheets

(56) References Cited

U.S. PATENT DOCUMENTS

| | | | | |
|---|---|---|---|---|
| 2,751,130 | A | 6/1956 | Murphy | |
| 2,884,157 | A | 4/1959 | Lampkin | |
| 3,059,816 | A | 10/1962 | Goldstein | |
| 3,171,574 | A | 3/1965 | Simms | |
| 3,739,938 | A | 6/1973 | Paz | |
| 3,847,311 | A | 11/1974 | Flores et al. | |
| 3,964,631 | A * | 6/1976 | Albert | 220/715 |
| 3,967,748 | A | 7/1976 | Albert | |
| 3,972,443 | A | 8/1976 | Albert | |
| 4,057,167 | A | 11/1977 | Lee | |
| 4,094,433 | A | 6/1978 | Numbers | |
| 4,099,642 | A | 7/1978 | Nergard | |
| 4,133,446 | A | 1/1979 | Albert | |
| 4,136,799 | A | 1/1979 | Albert | |
| 4,212,408 | A | 7/1980 | Valenzona | |
| 4,276,992 | A | 7/1981 | Susich | |
| 4,303,173 | A | 12/1981 | Nergard | |
| 4,561,560 | A | 12/1985 | Lyon | |
| 4,607,768 | A | 8/1986 | Taber et al. | |
| 4,676,411 | A | 6/1987 | Simasaki | |
| 4,712,704 | A | 12/1987 | Ramsey et al. | |
| 4,782,985 | A | 11/1988 | Kinsley | |
| 4,832,219 | A | 5/1989 | Nycz | |
| 4,911,337 | A | 3/1990 | Rosenthal | |
| 5,082,134 | A | 1/1992 | Ramsey | |
| 5,148,936 | A | 9/1992 | DeGrow | |
| 5,169,016 | A | 12/1992 | Hinz, Jr. | |
| 5,186,353 | A | 2/1993 | Ramsey | |
| 5,188,266 | A | 2/1993 | Loulias | |
| 5,199,597 | A | 4/1993 | Gladish | |
| 5,273,194 | A | 12/1993 | McNamara | |
| 5,307,950 | A | 5/1994 | Li | |
| 5,413,257 | A | 5/1995 | Amberger et al. | |
| 5,427,271 | A | 6/1995 | Wang | |
| 5,462,189 | A | 10/1995 | Pierce | |
| 5,485,938 | A | 1/1996 | Boersma | |
| D377,758 | S | 2/1997 | Valley | |
| 5,605,254 | A | 2/1997 | Wagner, III et al. | |
| 5,711,452 | A | 1/1998 | Chaffin | |
| 5,735,438 | A | 4/1998 | Ostrowsky | |
| 6,098,834 | A * | 8/2000 | Hatsumoto et al. | 220/715 |
| 6,116,476 | A | 9/2000 | Huang | |
| 6,257,452 | B1 | 7/2001 | Allen | |
| 6,336,574 | B1 | 1/2002 | Hins | |
| D463,215 | S | 9/2002 | Huang et al. | |
| D473,790 | S | 4/2003 | Nottingham et al. | |
| 6,557,717 | B1 | 5/2003 | Keck | |
| 6,702,138 | B1 | 3/2004 | Bielecki et al. | |
| 6,752,287 | B1 | 6/2004 | Lin | |
| 6,752,331 | B2 | 6/2004 | Wu | |
| 6,763,964 | B1 | 7/2004 | Hurlbut et al. | |
| D500,231 | S | 12/2004 | Ward et al. | |
| D500,428 | S | 1/2005 | Ward et al. | |
| 6,935,536 | B2 | 8/2005 | Tardif | |
| D509,408 | S | 9/2005 | Ward et al. | |
| D515,357 | S | 2/2006 | Ward et al. | |
| 7,011,227 | B2 | 3/2006 | Ward et al. | |
| D524,107 | S | 7/2006 | El-Saden et al. | |
| 7,073,678 | B1 | 7/2006 | Dibdin et al. | |
| D532,297 | S | 11/2006 | Myers et al. | |
| 7,172,533 | B2 | 2/2007 | Hobbs | |
| 7,195,137 | B2 | 3/2007 | Belcastro | |
| D547,607 | S | 7/2007 | Forsman | |
| D557,075 | S | 12/2007 | Lucaci et al. | |
| 7,306,113 | B2 | 12/2007 | El-Saden et al. | |
| D564,841 | S | 3/2008 | Clemens et al. | |
| 7,413,096 | B2 | 8/2008 | Morgan et al. | |
| 7,416,093 | B2 | 8/2008 | Lin et al. | |
| D581,727 | S | 12/2008 | Pinelli et al. | |
| 7,513,380 | B2 | 4/2009 | Canedo | |
| D592,456 | S | 5/2009 | Pinelli et al. | |
| D592,905 | S | 5/2009 | Pinelli et al. | |
| D592,913 | S | 5/2009 | Pinelli et al. | |
| 7,533,783 | B2 | 5/2009 | Choi et al. | |
| 7,546,933 | B2 | 6/2009 | Pinelli | |
| 7,740,147 | B1 | 6/2010 | Gilbert | |
| 7,770,763 | B2 | 8/2010 | Faure | |
| D624,362 | S | 9/2010 | Wahl | |
| D626,837 | S | 11/2010 | Meyers et al. | |
| D626,838 | S | 11/2010 | Meyers et al. | |
| D628,888 | S | 12/2010 | Groubert et al. | |
| D628,889 | S | 12/2010 | Groubert et al. | |
| D628,891 | S | 12/2010 | Groubert et al. | |
| D640,093 | S | 6/2011 | Picozza et al. | |
| D642,915 | S | 8/2011 | Swingle et al. | |
| D643,249 | S | 8/2011 | Miller et al. | |
| 7,997,442 | B2 | 8/2011 | Pinelli | |
| 8,056,745 | B2 | 11/2011 | Yu | |
| D651,855 | S | 1/2012 | Elsaden et al. | |
| D652,256 | S | 1/2012 | Eyal | |
| 8,091,730 | B2 | 1/2012 | Keefe et al. | |
| 8,118,184 | B2 | 2/2012 | Ruse, Jr. | |
| 8,118,329 | B2 | 2/2012 | Braga | |
| D656,360 | S | 3/2012 | Miller et al. | |
| D656,787 | S | 4/2012 | Phillips et al. | |
| D657,618 | S | 4/2012 | Wahl | |
| 8,191,727 | B2 | 6/2012 | Davies et al. | |
| 8,272,532 | B2 | 9/2012 | Michaelian et al. | |
| 8,275,532 | B2 | 9/2012 | Blaise et al. | |
| 8,276,776 | B2 | 10/2012 | Roth et al. | |
| 8,297,462 | B1 | 10/2012 | Joyce | |
| 8,360,258 | B2 | 1/2013 | Gilbert et al. | |
| 8,360,267 | B1 | 1/2013 | Chiou et al. | |
| 8,376,162 | B2 | 2/2013 | Yang | |
| 8,397,940 | B2 | 3/2013 | Steininger | |
| 8,403,173 | B2 | 3/2013 | Wahl et al. | |
| D683,581 | S | 6/2013 | Archer | |
| 8,459,510 | B2 | 6/2013 | Richards et al. | |
| 8,464,895 | B2 | 6/2013 | Gilbert et al. | |
| 8,573,431 | B2 | 11/2013 | Shepard et al. | |
| 8,590,731 | B2 | 11/2013 | Pinelli | |
| D699,509 | S | 2/2014 | El-Saden et al. | |
| D700,014 | S | 2/2014 | Zeanah | |
| D702,079 | S | 4/2014 | Hung | |
| 8,746,496 | B2 | 6/2014 | Gilbert et al. | |
| 8,844,762 | B2 | 9/2014 | Chiou et al. | |
| 8,863,979 | B2 | 10/2014 | El-Saden et al. | |
| 2003/0136783 | A1 | 7/2003 | Hatsumoto et al. | |
| 2003/0226859 | A1 | 12/2003 | Takagawa | |
| 2004/0108336 | A1 | 6/2004 | Tardif | |
| 2005/0029265 | A1 | 2/2005 | Morgan et al. | |
| 2005/0046210 | A1 | 3/2005 | Ward et al. | |
| 2005/0046211 | A1 | 3/2005 | Nole et al. | |
| 2005/0067792 | A1 | 3/2005 | Pulik | |
| 2006/0043091 | A1 | 3/2006 | Pinelli et al. | |
| 2006/0163262 | A1 | 7/2006 | El-Saden et al. | |
| 2006/0226160 | A1 | 10/2006 | Elsaden et al. | |
| 2007/0170184 | A1 | 7/2007 | Canedo | |
| 2007/0210093 | A1 | 9/2007 | Pinelli | |
| 2008/0272134 | A1 | 11/2008 | Rohe | |
| 2009/0159595 | A1 | 6/2009 | Michaelian et al. | |
| 2009/0250480 | A1 | 10/2009 | Pinelli | |
| 2011/0174993 | A1 | 7/2011 | Blain | |
| 2011/0309095 | A1 | 12/2011 | Pinelli | |
| 2012/0043295 | A1 | 2/2012 | Webster et al. | |
| 2012/0097690 | A1 | 4/2012 | Chien | |
| 2012/0187075 | A1 | 7/2012 | El-Saden et al. | |
| 2014/0217128 | A1 | 8/2014 | Samartgis | |
| 2014/0263476 | A1 | 9/2014 | Blain et al. | |

FOREIGN PATENT DOCUMENTS

| | | | |
|---|---|---|---|
| CN | 101549769 | A | 10/2009 |
| EP | 2220977 | A2 | 8/2010 |
| EP | 2567909 | A1 | 3/2013 |
| JP | 2003-212258 | A | 7/2003 |
| JP | 2004-167147 | A | 6/2004 |
| JP | 2005-193944 | A | 7/2005 |
| JP | 2005-278855 | A | 10/2005 |
| JP | 2007-197091 | A | 8/2007 |
| JP | 3158740 | U | 3/2010 |
| KR | 10-1997-0005188 | | 10/1999 |
| KR | 10-2010-00024537 | | 1/2011 |
| WO | WO 2005/115204 | A1 | 12/2005 |

(56) References Cited

FOREIGN PATENT DOCUMENTS

| | | |
|---|---|---|
| WO | WO 2009/010087 | 1/2009 |
| WO | WO 2010/031975 A1 | 3/2010 |
| WO | WO 2012/068033 | 5/2012 |
| WO | WO 2012/103364 | 8/2012 |

OTHER PUBLICATIONS

English-language abstract of Japan Patent Publication No. JP 2003-212258A, European Patent Office, Jul. 30, 2003.

English-language abstract of China Patent No. CN 2603023Y, European Patent Office, Feb. 11, 2004.

English-language abstract of Japan Patent Publication No. JP 2004-167147A, European Patent Office, Jun. 17, 2004.

English machine translation of Japan Patent Publication No. JP 2005-193944A, Jul. 21, 2005.

English-language abstract of Japan Patent Publication No. JP 2005-27885A, European Patent Office, Oct. 13, 2005.

English translation of Japan Patent Publication No. JP 2005-27885A, MultiLing Corporation, Oct. 13, 2005.

English-language abstract of Japan Patent Publication No. JP 2007-197091A, European Patent Office, Aug. 9, 2007.

English translation of Japan Patent Publication No. JP 2007-197091A, MultiLing Corporation, Aug. 9, 2007.

English-language abstract of China Patent Publication No. CN 101549769A, European Patent Office, Oct. 7, 2009.

English machine translation of Japan Unexamined Patent Publication No. JP 3158740U, Japan Patent Office, Mar. 24, 2010.

English-language abstract of PCT Patent Application Publication No. WO 2010/031975A1, World Intellectual Property Organization, Mar. 25, 2010.

English-language abstract of Korea Patent Publication No. KR 10-2010-0024537, Jan. 14, 2011.

* cited by examiner

DRINK CONTAINERS AND CAP ASSEMBLIES

RELATED APPLICATIONS

This application claims priority under 35 U.S.C. §119(e) to U.S. Provisional Patent Application No. 61/788,811, which is entitled "DRINK CONTAINERS AND CAP ASSEMBLIES WITH EXTERNAL ACTUATORS AND OUTLET CLOSURES" and was filed on Mar. 15, 2013, and to U.S. Provisional Patent Application No. 61/859,695, which is entitled "DRINK CONTAINERS AND CAP ASSEMBLIES WITH EXTERNAL ACTUATORS AND OUTLET CLOSURES" and was filed on Jul. 29, 2013, the disclosures of which are hereby incorporated by reference.

FIELD

The present disclosure relates to drink containers, and more particularly to portable drink containers and cap assemblies for portable drink containers.

BACKGROUND

Beverage containers come in a variety of configurations and are used to carry a variety of beverages for consumption by a user. Some beverage containers have an open top, and a user simply engages the lip or neck of the beverage container to consume a beverage from the container. Other beverage containers have a lid that is separate from, but removably coupled to, a vessel, with the lid including some form of drink spout through which a beverage is dispensed for consumption by a user. Such beverage containers may be in the form of sports bottles, water bottles, travel mugs, vacuum bottles, and the like. Some such beverage containers have a cap with a drink spout that may be selectively opened and closed to permit a user to selectively seal and unseal the drink spout, and some drink containers and/or caps further include a manual actuator and closure for selectively opening and closing the drink spout. When such beverage containers are used with beverages other than water, such as that include sugar or other suspended particulates that may stick to or otherwise foul components associated with drink spouts, actuators, or other internal components of the cap, it may be difficult to clean these portions of the cap and/or drink container.

SUMMARY

Drink containers and corresponding cap assemblies are disclosed herein. Cap assemblies according to the present disclosure include a body that defines a drink outlet for dispensing drink liquid to a user, and an operational assembly that is operatively coupled to the body. The operational assembly has at least an open configuration and a closed configuration. The operational assembly includes an outlet closure that is configured to restrict drink liquid from exiting the liquid container via the drink outlet when the operational assembly is in the closed configuration and to permit drink liquid to exit the liquid container via the drink outlet when the operational assembly is in the open configuration. The operational assembly also includes an actuator that is configured to be selectively engaged by a user to selectively reconfigure the operational assembly from the closed configuration to the open configuration for consumption of drink liquid from the liquid container.

In some embodiments, the operational assembly also includes an optional cleaning configuration, in which the outlet closure is spaced away from the body of the cap assembly for ease of cleaning the components of the cap assembly. In some such embodiments, the operational assembly is restricted from being configured to the cleaning configuration while the cap assembly is operatively coupled to the liquid container.

In some embodiments, the body of the cap assembly defines a drink spout that is sized and positioned to expose drink liquid to ambient air when drink liquid is dispensed from the drink outlet to a user.

In some embodiments, the outlet closure includes at least one member that extends from proximate the actuator to a distal tip of the outlet closure and along an upper side of the body of the cap assembly. In some such embodiments, a pair of members is utilized and define a space between the members that is sized to receive at least a portion of a user's nose when the user is drinking from the drink container.

DESCRIPTION

Figure 1:
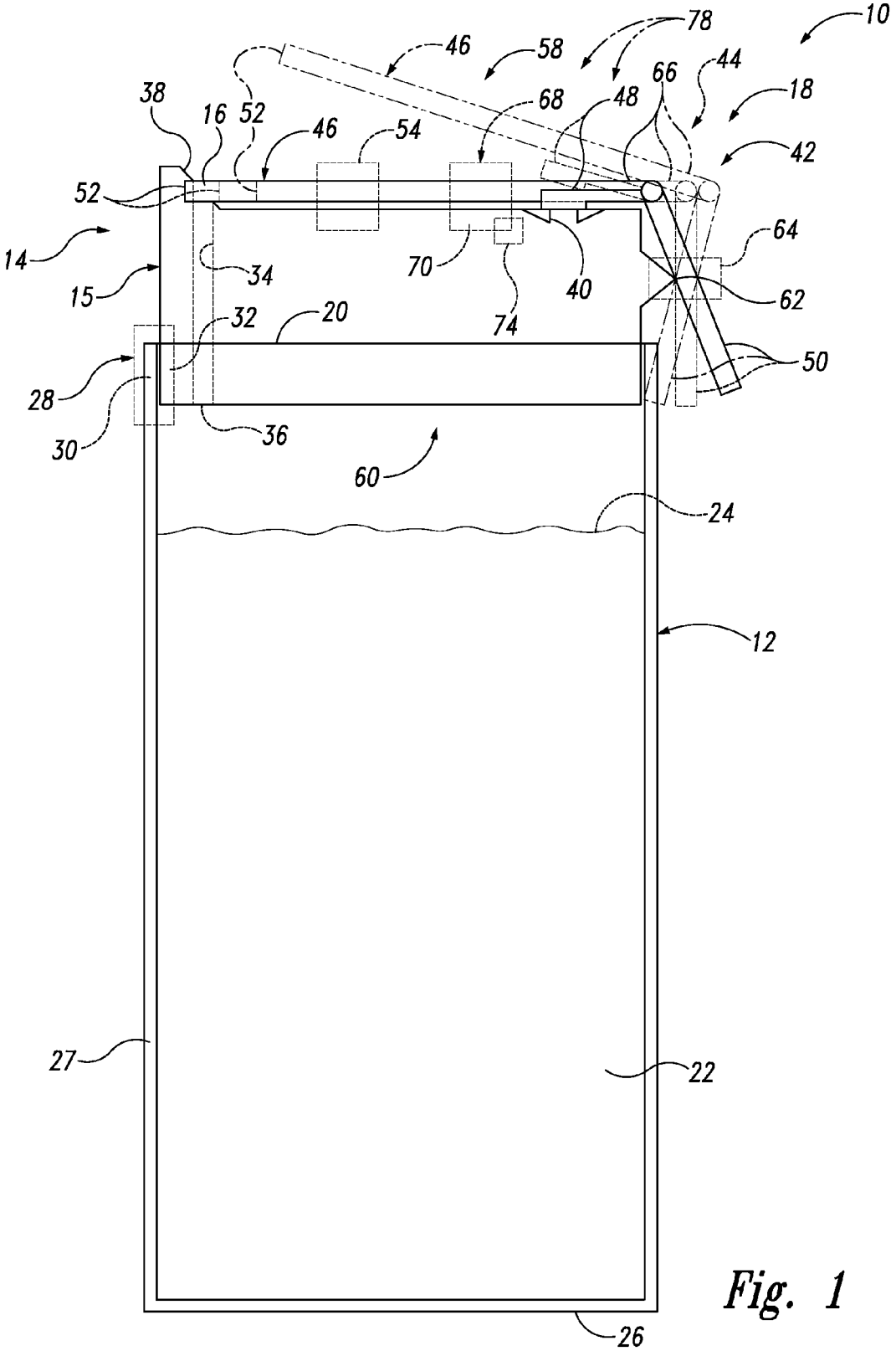
FIG. 1 is a schematic diagram representing illustrative, non-exclusive examples of drink containers according to the present disclosure.

Drink containers 10 and cap assemblies 14 with external actuators and outlet closures according to the present disclosure are schematically illustrated in FIG. 1. Drink containers 10 according to the present disclosure are designed to receive and selectively dispense to a user a volume of potable drink liquid. Illustrative, non-exclusive examples of drink liquids that may be used in drink containers 10 according to the present disclosure include such potable liquids as coffee, tea, water, juice, sports drinks, milk, soft drinks, and the like. Some drink containers according to the present disclosure are configured to hold hot and/or cold beverages and may be described as thermally-insulated beverage containers. Drink containers 10 include at least a liquid container 12 and a cap assembly 14.

As discussed in more detail herein, cap assembly 14 includes a body 15 and an operational assembly 18 that is operatively coupled to the body 15. The body defines a drink outlet 16, through which drink liquid may be selectively dispensed to a user, and the operational assembly 18 provides a mechanism that enables a user to selectively unseal and reseal the drink outlet for selective dispensing of drink liquid from the liquid container through the drink outlet. In some embodiments of cap assemblies 14, the operational assembly is predominantly, or even entirely, positioned external of the body of the cap assembly and external of the liquid container. Accordingly, in such embodiments, the operational assembly may be secured to the exterior of the body of the cap assembly and/or may be configured to selectively seal the drink outlet from external the cap assembly's body, as opposed to sealing from the underside or interior portion of the cap assembly. Such operational assemblies additionally or alternatively may be described as being secured, mounted, and/or otherwise positioned generally on the outside of the cap assembly, and/or on the outside/exterior of the drink container, when the cap assembly is operatively coupled to a liquid container.

Liquid containers 12 according to the present disclosure are adapted to receive and hold or otherwise contain up to a predetermined volume of drink liquid 24 for selective consumption by a user. Liquid containers 12 may include an open neck 20, through which drink liquid may be selectively poured, or otherwise dispensed, into an internal compartment 22 of the liquid container, and from which the drink liquid may be selectively dispensed from the internal compartment to a user, such as when the cap assembly is not secured to the neck. It is within the scope of the present disclosure that neck 20 may (but is not required in all embodiments to) define the only opening through which drink liquid may be added to or removed from the liquid container. As discussed in more detail herein, when cap assembly 14 is operatively coupled to the liquid container, this selective dispensing of the drink liquid may be only through the drink outlet 16 of the cap assembly.

Liquid containers 12 may have any suitable shape and may be formed from any suitable material or combination of materials to hold up to a predetermined volume of drink liquid. Illustrative, non-exclusive examples of suitable sizes, or capacities, of liquid containers 12 (i.e., volume of drink liquid 24 able to be received into a liquid container at one time) include 4 oz., 6 oz., 8 oz., 10 oz., 12 oz., 16 oz., 20 oz., 24 oz., 32 oz., 36 oz., 4-11 oz., 6-15 oz., 10-19 oz., 12-25 oz., 12-36 oz., 15-30 oz., 25-36 oz., and 10-70 oz. (with these illustrative, non-exclusive examples referring to liquid (fluid) ounces of drink liquid that may be received at one time into an empty liquid container). This volume of drink liquid additionally or alternatively may be referred to as the capacity or maximum volume of the empty liquid container. It is within the scope of the present disclosure that liquid containers having different sizes, including sizes that are smaller than, larger than, or within the illustrative sizes and/or ranges presented above, may be used without departing from the scope of the present disclosure.

An illustrative, non-exclusive example of a material that may be used to construct liquid containers 12 according to the present disclosure includes the TRITAN™ copolyester polymer developed by Eastman Chemical Company. Other illustrative, non-exclusive examples of materials that may be suitable for construction of liquid containers, and/or portions thereof, according to the present disclosure include polycarbonate, glass, plastic, and/or metal, such as aluminum or stainless steel. Further illustrative, non-exclusive examples of materials are disclosed in U.S. Pat. No. 7,533,783, the disclosure of which is incorporated herein by reference.

Liquid containers 12 may be (but are not required to be) rigid or at least semi-rigid and may include a bottom surface 26 such that a liquid container may be generally self-supporting, or free-standing when placed on a horizontal surface. Liquid containers also may be (but are not required to be) thermally-insulated. In FIG. 1, the liquid container 12 is schematically illustrated with a double-walled construction; however, other configurations of thermal insulation also may be used. As a further illustrative, non-exclusive example, when a double-walled construction is utilized, the space, or volume, 27 between the walls may be filled with a solid, liquid, and/or gaseous insulating material. When drink containers 10 include a thermally-insulated liquid container, the drink containers may be referred to as, described as, and/or otherwise be a thermally-insulated drink container, a thermally-insulated beverage container, a vacuum bottle, a travel mug, a travel container, a portable coffee mug, etc. Cap assemblies 14 additionally or alternatively may be thermally-insulated and may include a double-walled, or other thermally-insulated, construction, and optionally may include at least one layer of insulating material other than the walls that form the outer surfaces of the cap assembly.

While cap assemblies 14 are configured to be used with liquid containers 12, and/or sold and/or used as a portion of a drink container 10, it is within the scope of the present disclosure that a cap assembly may be provided without an associated liquid container and/or designed for use with a variety of different liquid containers. For example, a cap assembly 14 may be provided as a replacement and/or alternative cap assembly for a liquid container. Additionally or alternatively, a cap assembly may be configured to be used with a generic liquid container that is not necessarily specifically configured, sold, and/or intended to be used with a cap assembly 14 according to the present disclosure.

Cap assemblies 14 according to the present disclosure are configured to be removably coupled to a liquid container 12 to cover, or otherwise enclose, the neck 20 thereof. When so coupled to a liquid container, a cap assembly 14 restricts drink liquid within the liquid container's internal compartment 22 from being dispensed from the drink container other than through drink outlet 16. When the drink outlet is obstructed or otherwise closed or sealed by operational assembly 18, the cap assembly prevents drink liquid from being dispensed from the liquid container through the drink outlet. Accordingly, any drink liquid in the internal compartment of the liquid container is prevented from being dispensed to a user or otherwise removed from the liquid container until either the cap assembly is uncoupled from the liquid container or until the operational assembly 18 is configured, such as to an open or dispensing configuration thereof, to permit dispensing of drink liquid through drink outlet 16.

Although not required in all embodiments, cap assembly 14 typically is removably coupled to liquid container 12, such as to neck 20 thereof, to permit selective and non-destructive removal and replacement (i.e., repeated uncoupling and recoupling) of the cap assembly relative to the liquid container. For example, cap assembly 14 may be uncoupled from the liquid container to permit the liquid container to receive a volume of drink liquid, after which the cap assembly may be recoupled to the liquid container. Accordingly, drink containers 10 according to the present disclosure may include a coupling assembly 28 that is configured to removably couple the cap assembly and the liquid container together. Coupling assembly 28 includes coupling structures 30 and 32, with liquid container 12 including coupling structure 30, and with cap assembly 14 including coupling structure 32, which is configured to selectively mate with coupling structure 30. In such an embodiment, neck 20 of the liquid container may include coupling structure 30. Coupling assembly 28 may provide a liquid-tight connection between the cap assembly and the liquid container. When such a connection is established between the cap assembly and the liquid container, the cap assembly may restrict liquid from being dispensed from the drink container other than through drink outlet 16. Illustrative, non-exclusive examples of coupling assembly 28 that may be incorporated into drink containers according to the present disclosure include (but are not limited to) threads, snap-fit arrangements, friction-fit arrangements, clasp arrangements, etc.

Drink outlet 16 may take any suitable form and may be described as being defined by a passage, or conduit, 34 through which drink liquid from the internal compartment of the liquid container may be selectively dispensed from an inlet 36 to drink outlet 16. Passage 34 additionally or alternatively may be referred to as a drink passage, a liquid passage, an outlet conduit, and/or a dispensing passage 34. As used herein, the inlet of the passage refers to the portion of the passage that is closest to the internal compartment of the drink container and into which drink liquid first passes from the internal compartment of the drink container as the drink liquid is dispensed through the passage. Similarly, the drink outlet refers to the portion of the passage that is farthest away from the internal compartment of the drink container and/or from which the drink liquid last passes from the internal compartment of the drink container as the drink liquid is dispensed from the passage to a user.

The distance between inlet 36 and drink outlet 16 may vary without departing from the scope of the present disclosure. In some embodiments, this distance (which also may be described as the length of the drink passage) may be relatively short, such as being equal to the thickness of the top layer of material of the cap assembly proximate outlet 16. In other embodiments, this distance may be greater, such as at least 2, 3, 4, 5, 10 or more times the above-discussed thickness. Further illustrative, non-exclusive examples include distances of at least 2 mm, at least 3 mm, at least 4 mm, at least 5 mm, at least 10 mm, at least 20 mm, at least 30 mm, or at least 40 mm, distances that are less than 50 mm, less than 40 mm, less than 30 mm, less than 20 mm, less than 15 mm, less than 10 mm, or less than 5 mm, and/or distances that are bounded by any of the preceding examples.

As discussed, cap assemblies 14 according to the present disclosure include a body 15 and an operational assembly 18 that is operatively coupled to the body of the cap assembly. In some embodiments, the operational assembly is operatively coupled generally to the outside, outer/exterior surface, of the body. In other words, when the cap assembly is coupled to a liquid container, the operational assembly is generally accessible and visible, as discussed in more detail herein. Although not required to all embodiments, in such a position, most, if not all, of the operational assembly may not be contacted by the drink liquid as the drink liquid is dispensed from the cap assembly through the drink outlet (i.e., when the operational assembly and/or cap assembly is/are in an open configuration). Furthermore (and again, although not required to all embodiments), when the drink outlet is sealed by the operational assembly (i.e., when the operational assembly and/or cap assembly is/are in a closed configuration), at most only the outlet closure and/or vent closure thereof may be contacted by drink liquid in the drink container.

The body of the cap assembly defines the drink outlet 16, through which drink liquid may be selectively dispensed to a user. In some embodiments (although not required to all embodiments), the body also defines a vent 40, through which gas may enter and exit the internal compartment 22 of the liquid container 12. For example, a vent may be used in embodiments of drink containers that are configured to hold hot and/or cold beverages, with the vent providing a mechanism for heat exchange between the drink liquid and the environment external the drink container. As a further example, the vent may permit steam and/or other hot gases to exit the internal compartment of the liquid container through the vent when the liquid is a hot liquid. Additionally or alternatively, a vent may be used in embodiments of drink containers that utilize liquid containers with a rigid construction, so that air may enter the internal compartment of the liquid container when a user is consuming drink liquid via the drink outlet. However, embodiments of cap assemblies without a vent that is separate and apart from the drink outlet are within the scope of the present disclosure.

The body 15 of cap assembly 14 may take any suitable form and may be defined by a monolithic structure or by an assembly of more than one structure. Typically, the body will be constructed of plastic and/or metal and will define a drink spout 38 associated with the drink outlet 16. When present, the drink spout may define a conduit or a surface that is configured and shaped to be engaged by a user's mouth to receive drink liquid from the drink container as it is dispensed through the drink outlet, for example by a user tilting the drink container in a typical drinking motion associated with consumption of drink liquids from a container.

Figure 2:
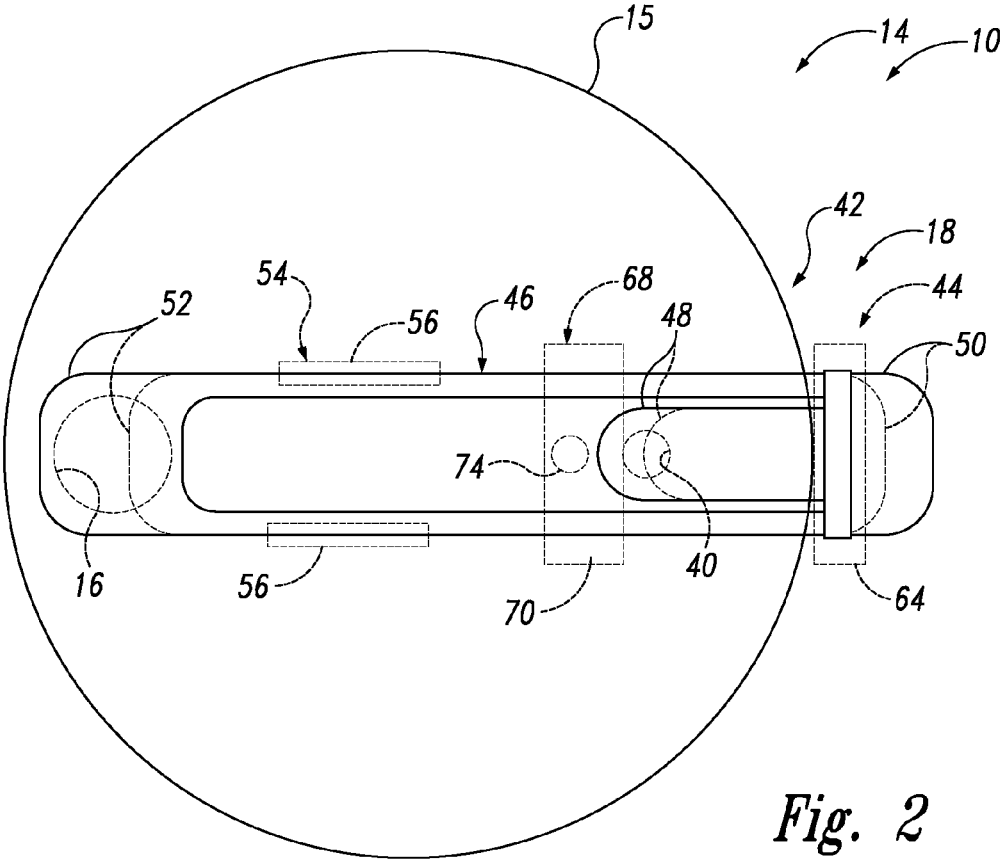
FIG. 2 is a schematic top view diagram representing illustrative, non-exclusive examples of cap assemblies according to the present disclosure.

Operational assembly 18 has at least a closed configuration 42, which is schematically illustrated in solid lines in FIGS. 1-2, and an open configuration 44, which is schematically illustrated in dashed lines in FIGS. 1-2. Additionally or alternatively, the cap assembly 14 may be described as having a closed configuration 42 and an open configuration 44. The operational assembly includes at least an outlet closure 46 and an actuator 50, and in embodiments of cap assemblies 14 that define a vent 40, the operational assembly also may include a vent closure 48. Actuator 50 is configured to be selectively engaged by a user to selectively reconfigure the operational assembly from the closed configuration to the open configuration.

The outlet closure is configured to restrict drink liquid from exiting the liquid container via the drink outlet 16 when the operational assembly is in the closed configuration, and to permit drink liquid to exit the liquid container via the drink outlet when the operational assembly is in the open configuration. In some embodiments, the outlet closure may be described as plugging, obstructing, and/or otherwise sealing the drink outlet when the operational assembly is in the closed configuration, and as unplugging, unsealing, and/or otherwise not completely obstructing liquid flow through the drink outlet when the operational assembly is in the open configuration. This is schematically represented in FIG. 1, with a distal end region 52 extending into the drink outlet 16 when the operational assembly is in the closed configuration, as illustrated in solid lines in FIG. 1, and with the distal end region 52 being spaced away from the drink outlet when the operational assembly is in the open configuration, as illustrated in dashed lines in FIG. 1. Additionally or alternatively, in some embodiments, the outlet closure may be described as covering and/or closing the drink outlet when the operational assembly is in the closed configuration and as uncovering and/or opening the drink outlet when the operational assembly is in the open configuration. This is schematically represented in FIG. 2, with the distal end region 52 extending over the drink outlet 16 when the operational assembly is in the closed configuration, as illustrated in solid lines in FIG. 1, and with the distal end region 52 at least partially uncovering the drink outlet when the operational assembly is in the open configuration, as illustrated in dashed lines in FIG. 2.

In some embodiments, the outlet closure may be configured to translate linearly, or generally linearly, when the operational assembly reconfigures between the closed configuration and the open configuration, such as schematically represented in FIGS. 1-2 between the closed configuration 42 in solid lines and the open configuration 44 in dashed lines; however, such a configuration is not required to all embodiments according to the present disclosure. For example, pivotal arrangements and/or combination pivotal/translational arrangements of outlet closures also are within the scope of the present disclosure. The outlet closure 46 additionally or alternatively may be described or referred to as a plug, a sliding plug, an outlet seal, a seal bar, an outlet sealing member, a plunger, and/or a translating member. The movement of the outlet closure between the open and closed configurations additionally or alternatively may be described as translational and/or axial movement along, across, above, exterior, on, and/or proximate the upper surface of the cap assembly. Furthermore, movement "across" the body of the cap assembly does not require movement across the entirety of the body of the cap assembly, such as the upper surface thereof.

As schematically illustrated in FIG. 1 at 54, the outlet closure 46 and/or the body 15 of the cap assembly may include and/or define structure that restrains movement of the outlet closure, such as to a linear motion, when moving between the open configuration and the closed configuration of the operational assembly. In some embodiments, the interface between the distal end region 52 and the drink outlet 16 may define such structure. Additionally or alternatively, the body 15 of the cap assembly may include structure that restricts movement of the outlet closure to linear movement, and/or restricts pivoting movement away from the upper surface of the cap assembly, at least when the operational assembly is being configured between the open configuration and the closed configuration. For example, as schematically represented in FIG. 2, the body may include and/or define one or more rails, lips, guides, or other structures 56 that at least partially bind the outlet closure on an upper side thereof. Additionally or alternatively, the cap assembly body may be described as including or defining a channel, within which the outlet closure is at least partially positioned and along which the outlet closure is configured to translate, at least when the operational assembly is reconfiguring between the open configuration and the closed configuration.

As used herein, relational terms such as upper, lower, above, below, top, bottom, up, down, etc. are in reference to the drink container and/or the cap assembly in a generally upright position, such as with the drink container positioned generally on a flat horizontal surface and with the cap assembly 14 operatively coupled to the liquid container 12, such as schematically represented in FIG. 1. Accordingly, the cap assembly 14 and component parts thereof, such as body 15, may be described as having an upper side, or upper surface, 58 and a lower side, or lower surface, 60. Additionally or alternatively, the upper side of the cap assembly and its base may be described as generally facing away from the internal compartment of the liquid container, and the lower side of the cap assembly and its base may be described as generally facing the internal compartment of the liquid container when the cap assembly is operatively coupled to the liquid container. Additionally, such relational terms as internal, interior, external, and exterior are in reference to when the cap assembly is operatively coupled to the liquid container, with the volume of space defined between the base of the cap assembly and the liquid container being internal to the drink container.

In some embodiments, outlet closure 46 may be positioned completely, or at least predominantly, on upper side 58 of body 15 of the cap assembly. Additionally or alternatively, the outlet closure may be positioned completely, or at least predominantly, on and/or adjacent to an external surface of the body of the cap assembly. Additionally or alternatively, the outlet closure may be positioned external of the drink container, or on the outside of the drink container, when the cap assembly is operatively coupled to the liquid container. Additionally or alternatively, in some embodiments, the outlet closure may be described as operatively closing, or sealing, the drink spout from an upper side of the cap assembly, from an upper side of the base of the cap assembly, from an external surface of the body of the cap assembly, from adjacent an external surface of the body of the cap assembly, and/or from external of the drink container. Additionally or alternatively, in some embodiments, operational assembly 18 may be described as being positioned, or at least predominantly positioned, external of the drink container, or on the outside of the drink container, when the cap assembly is operatively coupled to the liquid container. Such optional configurations of outlet closures and operational assemblies may be particularly well suited for drink containers that are configured or intended to be used with beverages other than water, such as that include sugar, fermentable components, or other suspended particulates that may stick to, and/or otherwise foul, components of typical drink containers. For example, drink containers that are used for hot beverages, such as coffee or tea, sweetened or fruit-based beverages such as juice, soda, or sports drinks, and/or dairy-based beverages such as milk and smoothies, may benefit from having components of the operational assembly positioned completely, or at least predominantly, external of the drink container. By having the operational assembly predominantly, if not completely, on the outside of the drink container, the component parts of the operational assembly will be less prone to becoming sticky, dirty, or otherwise soiled, and will be less prone to creating an environment for the growth of microorganisms. Moreover, such a configuration may facilitate ease of cleaning a cap assembly according to the present disclosure. By "predominantly," it is meant that most, or nearly all, of the operational assembly is outside of, or external to, the remainder of the body of the cap assembly. In percentage terms, this may be expressed as at least 75%, and optionally at least 85%, at least 90%, or even at least 95% of the operational assembly. Notwithstanding the preceding statements, drink containers 10 and/or cap assemblies 14 thereof also are well suited for use with water as the, or the primary, drink liquid.

As mentioned, cap assemblies 14 optionally may include a vent 40 and corresponding vent closure 48. When present, the vent closure is configured to restrict gas from entering and exiting the liquid container via the vent 40 when the operational assembly is in the closed configuration 42, such as illustrated schematically in solid lines in FIGS. 1-2, and to permit gas to enter and exit the liquid container via the vent when the operational assembly is in the open configuration 44, such as illustrated schematically in dashed lines in FIGS. 1-2. Although not required, the inclusion of a vent closure 48 may be desirable in embodiments of drink containers 10 that are configured, or intended to be used, for hot beverages, such as drink containers 10 that include a thermally-insulated liquid container and/or cap assembly. For example, in such situations, it may be desirable to maintain the elevated temperature of a hot beverage, and the vent closure may effectively serve to restrict loss of heat via the vent, such as associated with escape of steam and/or heated air present in the internal compartment above the hot beverage. However, for consumption of the hot beverage, it may be desirable to permit air to enter the internal compartment other than via the drink outlet 16, so as to avoid a vacuum being created within the internal compartment as drink liquid is dispensed through the drink outlet to a consumer. Accordingly, the vent closure may be provided and, as mentioned, may be configured to permit gas to enter the internal compartment when the operational assembly is in the open configuration. Additionally or alternatively, it may be desirable to permit hot air to escape when drink liquid is not being actively consumed, so as to permit a hot beverage to cool to a more desirable temperature prior to consumption.

In some embodiments, such as schematically illustrated in FIG. 1 in dashed lines, the vent closure 48 may be configured to pivot relative to the body of the cap assembly when the operational assembly is reconfigured between the closed configuration and the open configuration. However, such a configuration is not required to all embodiments, and in some embodiments, the vent closure may be configured to be translated generally linearly relative to the body of the cap assembly when the operational assembly reconfigures between the open configuration and the closed configuration, with this optional configuration of vent closures schematically being represented in FIG. 2. In some embodiments, although not required to all embodiments, the operative movement of the optional vent closure may occur together with the operative movement of the outlet closure responsive to a single user input, or actuation force, to the actuator 50.

In some embodiments, although not required to all embodiments, the vent closure 48 may be positioned on the upper side 58 of the base of the cap assembly. Additionally or alternatively, the vent closure may be positioned completely, or at least predominantly, on and/or adjacent to an external surface of the body of the cap assembly. Additionally or alternatively, the vent closure may be positioned external, or at least predominantly external, to the drink container when the cap assembly is coupled to the liquid container. Additionally or alternatively, the vent closure may be positioned external of the drink container, or on the outside of the drink container, when the cap assembly is coupled to the liquid container. Additionally or alternatively, in some embodiments, the vent closure may be described as operatively closing, obstructing, or otherwise sealing, the vent from an upper side of the cap assembly, from an upper side of the base of the cap assembly, and/or from external of the drink container.

As mentioned, actuator 50 is configured to be selectively engaged by a user to selectively reconfigure the operational assembly from the closed configuration to the open configuration. In some embodiments, the actuator may be biased, such as spring biased, such that the operational assembly is biased toward the closed configuration. In some embodiments, although not required to all embodiments, the actuator may be configured to be selectively pivoted relative to the body of the cap assembly to reconfigure the operational assembly from the closed configuration to the open configuration. In FIG. 1, a pivot axis 62 is schematically presented, about which the actuator 50 may be pivoted. However, other configurations of actuators also are within the scope of the present disclosure, including actuators that generally translate linearly in response to user engagement thereof, such as by a user pressing on the actuator.

In FIG. 1, a box 64 is schematically illustrated in an overlapping relationship with the body 15 of the cap assembly and the actuator 50 of the operational assembly 18. Box 64 schematically represents that the cap assembly and/or the operational assembly may include such additional structures as an axle, a spring, and/or other structures that operatively couple, and in some embodiments pivotally couple and/or biasly couple, the actuator to the base of the cap assembly.

In some embodiments, such as schematically illustrated in FIG. 1, the outlet closure 46 may be hinged, or otherwise pivotally or rotationally coupled to the actuator, so that when the actuator pivots relative to the base of the cap assembly, the outlet closure translates generally linearly relative to the body of the cap assembly. This is schematically illustrated and understood with reference to the operational assembly being illustrated in solid lines in its closed configuration and in dashed lines in its open configuration. As seen, the actuator pivots between the closed configuration and the open configuration, whereas the outlet closure generally translates linearly between the closed configuration and the open configuration. However, if the outlet closure and the actuator are operatively coupled by a single axis hinge, the proximate end region 66 of the outlet closure will necessarily pivot to some extent, together with the actuator. Even in such embodiments, however, the distal end region 52 of the outlet closure may more closely approach a true linear translation, due to one or more of the length of the outlet closure, the distance of the distal end region away from the coupling with the actuator, and/or the presence of optional restraining structure 54. It also is within the scope of the present disclosure that a more complex coupling between the outlet closure and the actuator is provided and incorporated into a cap assembly according to the present disclosure, such as to facilitate a true linear movement of the outlet closure relative to the body of the cap assembly when the operational assembly is reconfigured between the closed configuration and the open configuration.

In embodiments of cap assemblies 14 that include both an outlet closure and a vent closure, the operational assembly 18 may be configured such that selective actuation of the actuator to reconfigure the operational assembly from the closed configuration to the open configuration results in the outlet closure permitting drink liquid to exit the liquid container via the drink outlet simultaneously, or in some embodiments at least nearly simultaneously, with the vent closure permitting gas to enter and exit the liquid container via the vent. In other embodiments, the operational assembly may be configured such that selective actuation of the actuator to reconfigure the operational assembly from the closed configuration to the open configuration results in the vent closure permitting gas to enter and exit the liquid container via the vent at least a moment in time prior to the outlet closure permitting drink liquid to exit the liquid container via the drink outlet. In embodiments in which the vent closure is configured to unseal the vent prior to the outlet closure unsealing the drink outlet (when the actuator is engaged and actuated at a reasonable operative rate by a user), such a moment in time may be in the range of 0.05-0.5, 0.05-0.25, or 0.05-0.1 second, or may be less than or greater than 0.05, 0.1, 0.25, or 0.50 second, with these times being illustrative and non-exclusive and with times outside of or within these ranges being within the scope of the present disclosure.

As an illustrative, non-exclusive example of structure that may facilitate such a configuration in which the vent is unsealed prior to the drink outlet unsealing, the outlet closure may include a slot, within which a pin is positioned that is operatively coupled to the actuator. When the actuator is initially pivoted, the pin slides along the slot until it engages the end of the slot, at which point the outlet closure is caused to move as the actuator is further pivoted. In contrast, the vent closure may be directly coupled to the actuator so that it begins to move prior to the pin engaging the end of the slot.

Alternatively, it also is within the scope of the present disclosure that the operational assembly may be configured such that selective actuation of the actuator to reconfigure the operational assembly from the closed configuration to the open configuration results in the unsealing of the drink outlet at least a moment in time prior to the unsealing of the vent, with illustrative, non-exclusive examples of the duration of such moments in time including those identified above.

In some embodiments of drink containers 10 according to the present disclosure, the operational assembly 18 may be configured to be selectively and temporarily retained in the open configuration 44 (that is, without requiring a user to maintain continued actuation of the actuator). Stated differently, in some embodiments, the operational assembly may include a lock-open feature that is configured to facilitate selective and temporary retention of the operational assembly in the open configuration after a user has released the actuator. This lock-open feature additionally or alternatively may be referred to as a lock-open mechanism and/or a lock-open assembly. Such embodiments may be utilized, for example, in embodiments of drink containers 10 that are specially configured for use with hot beverages. For example, thermally-insulated drink containers 10 may be configured such that a hot beverage is introduced and/or maintained at a high temperature longer than desired by a user of the drink container. Accordingly, a user may selectively choose to temporarily lock (or otherwise retain without requiring constant manual force to be applied by the user) the operational assembly in its open configuration so that air and/or steam may circulate to and from the internal compartment via the drink outlet and/or the vent, so as to permit heat to escape from the internal compartment, and thus to permit the hot beverage to cool faster than if the operational assembly were maintained in its closed configuration 42. Additionally or alternatively, such a locked-open configuration may be desirable for a user to maintain the drink outlet in an unsealed position, so that the user is not required to engage and depress the actuator in connection with every instance of grasping and tilting the drink container for consumption of drink liquid via the drink outlet. Accordingly, the lock-open mechanism, when present and utilized, may retain the operational assembly in an open configuration, which may be referred to as a locked-open configuration, and to thereby permit the operational assembly to be retained in this configuration without requiring maintained (i.e., continuous actuation) of the actuation assembly by a user.

Such an optional lock-open feature, when present, may be implemented in any suitable manner. In examples of the operational assemblies in which the actuator 50 is biased (and thus the operational assembly is biased) toward the closed configuration, the operational assembly may include a locking mechanism 68 that is configured to be selectively engaged by a user to selectively and temporarily retain the operational assembly in the open configuration, with this optional locking mechanism 68 being schematically illustrated in FIGS. 1-2 as a dashed box overlapping the outlet closure and the body. In some embodiments, the body 15 of the cap assembly may include structure 70 that is configured to cooperate with the locking mechanism to selectively and temporarily retain the operational assembly in the open configuration. However, other configurations of locking mechanisms are within the scope of the present disclosure, such as that are integral with and/or that otherwise cooperate directly with the actuator.

Figure 3:
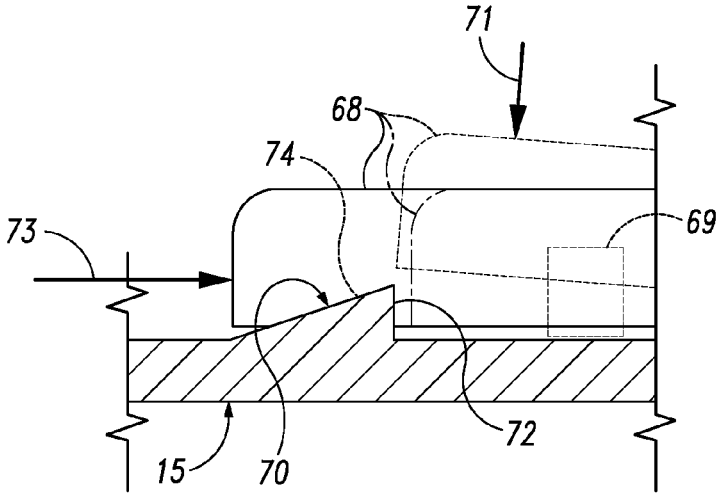
FIG. 3 is a schematic fragmentary diagram representing an optional lock-open feature of cap assemblies according to the present disclosure.
Figure 4:
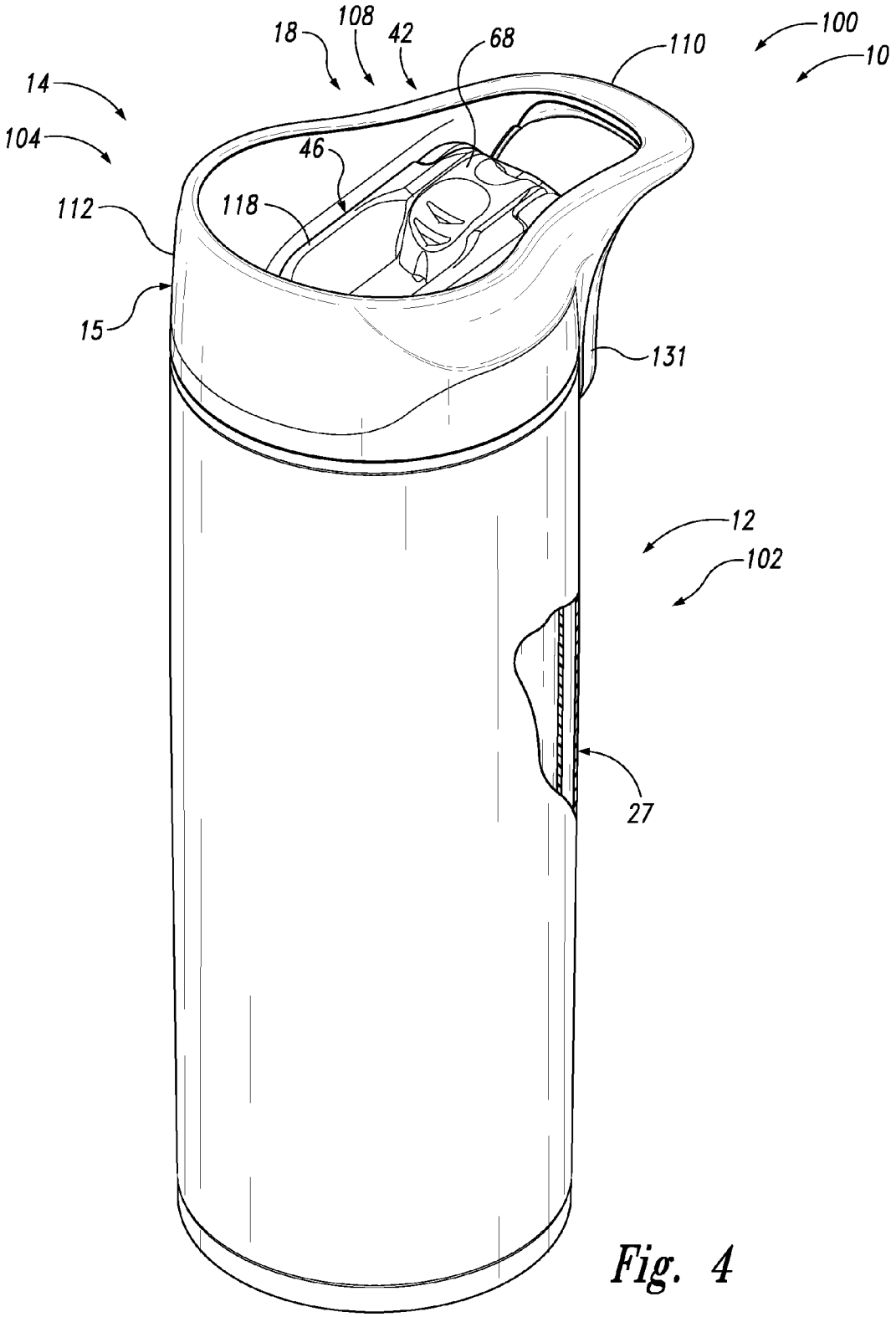
FIG. 4 is a perspective view of an illustrative, non-exclusive example of a drink container according to the present disclosure.
Figure 5:
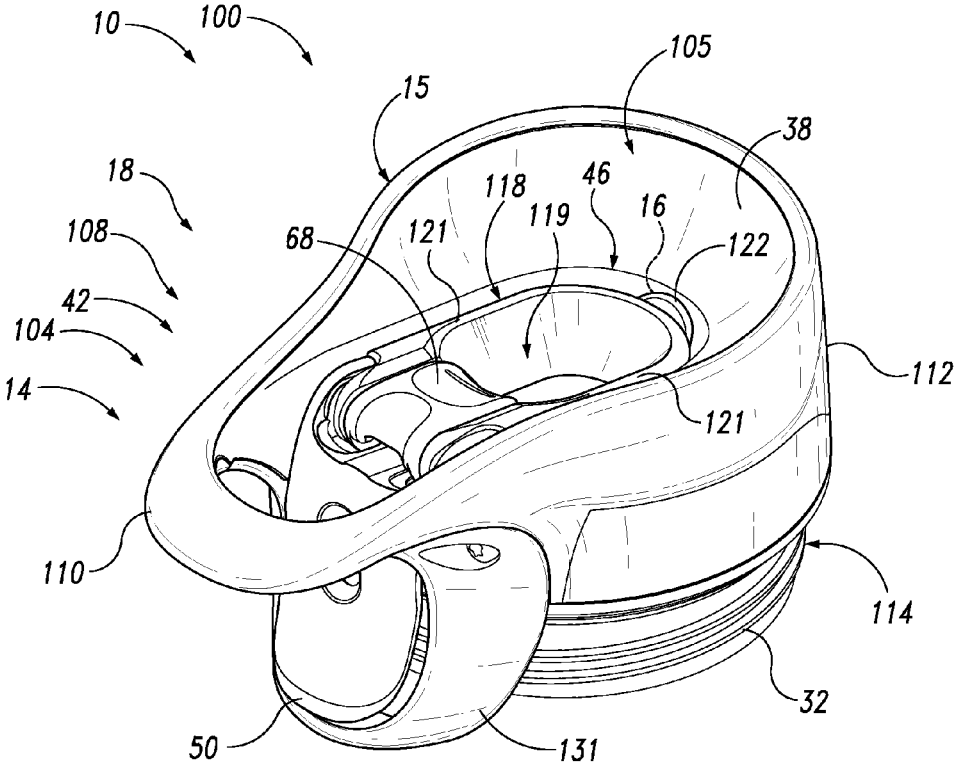
FIG. 5 is perspective view of the cap assembly of the drink container of FIG. 4.
Figure 6:
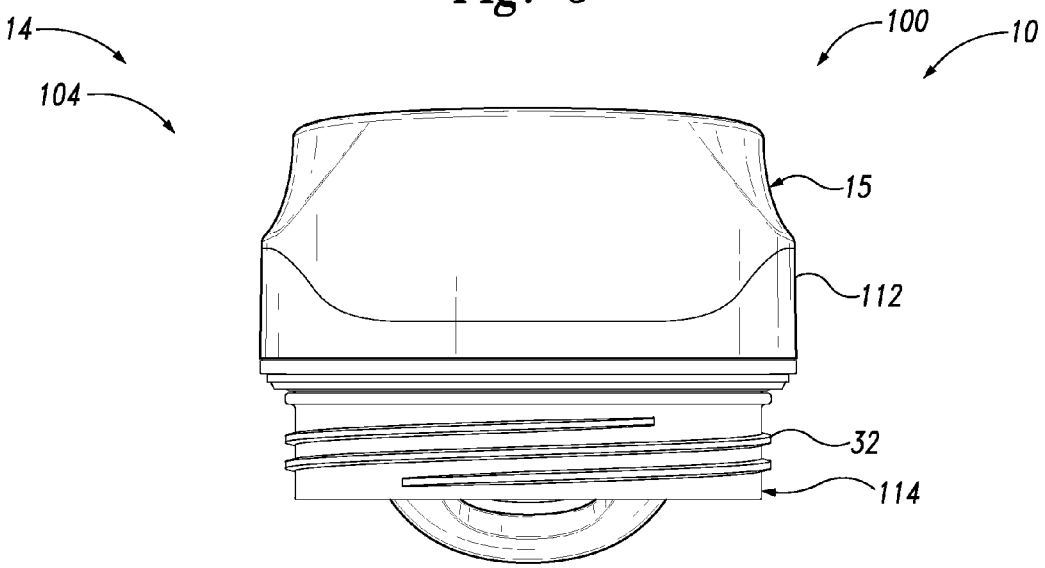
FIG. 6 is a front view of the cap assembly of the drink container of FIG. 4.
Figure 7:
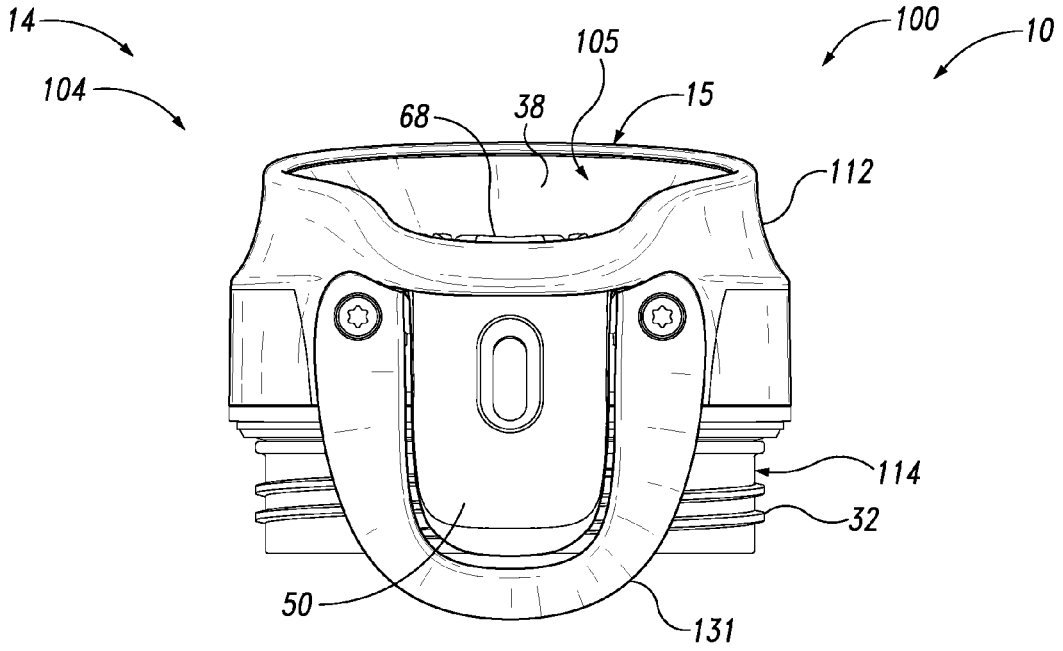
FIG. 7 is a rear view of the cap assembly of the drink container of FIG. 4.
Figure 8:
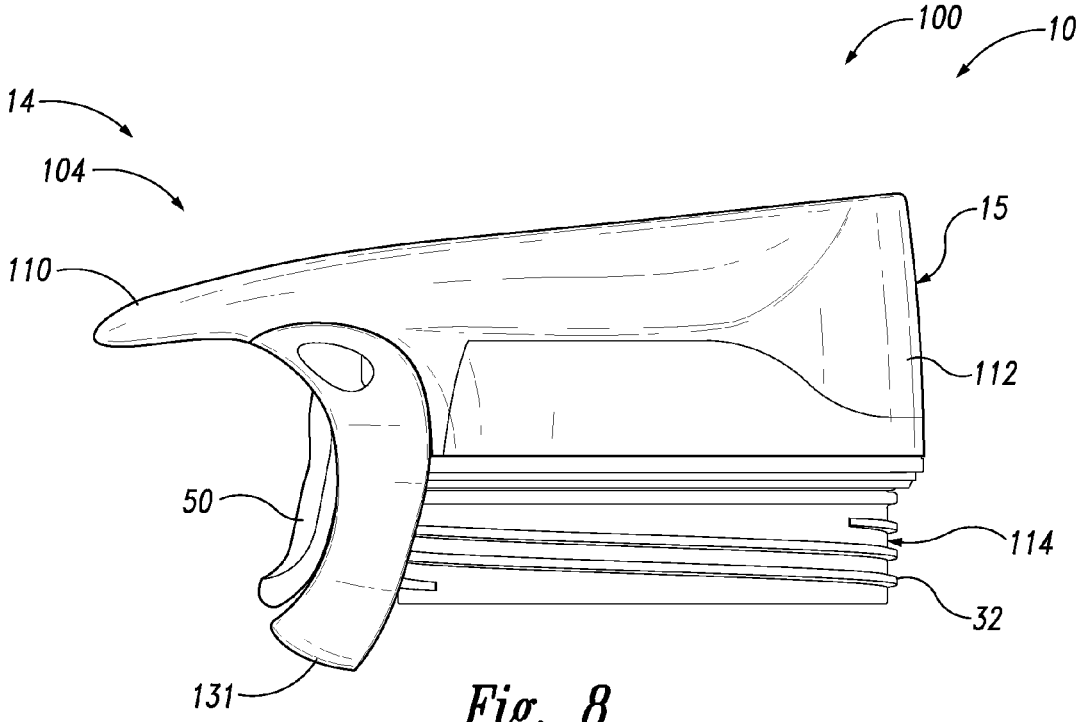
FIG. 8 is a right side view of the cap assembly of the drink container of FIG. 4.

FIG. 3 schematically presents an illustrative, non-exclusive example of a locking mechanism 68 according to the present disclosure. As schematically presented, the locking mechanism includes structure that is configured to translate between the closed position of the operational assembly (solid lines) and the open configuration of the operational assembly (dashed lines). As illustrated, body 15 includes structure 70 in the form of a ramped projection 72. Ramped projection 72 additionally or alternatively may be referred to as a projection 72, tab 72, detent 72, and/or ramped notch 72. When the operational assembly is in the open configuration, the locking mechanism may be engaged by a user and positioned behind the ramped projection (such as by being urged away from the drink spout and/or along the upper surface of the body of the cap assembly), as illustrated in dash-dot lines in FIG. 3 and represented by the downward force arrow at 71, so that when the user releases the actuator, the locking mechanism maintains, or retains, the operational assembly in the open configuration despite the bias of the operational assembly toward the closed position. Additionally or alternatively, as represented by the right directed arrow at 73 in FIG. 3, a user may engage the locking mechanism and apply a force that effectively reconfigures the operational assembly to the open configuration without directly engaging the actuator 50, until the locking mechanism catches on and is retained by the ramped projection 72. In such embodiments, the locking mechanism may be described as and/or may include a button. To selectively release the operational assembly from the open configuration to the closed configuration, the locking mechanism may be selectively engaged by a user so that it is no longer engaged with the ramped projection against the bias of the operational assembly. Additionally or alternatively, in some embodiments, selective engagement of the actuator 50 may result in the locking mechanism automatically disengaging the ramped projection 72. For example, this selective engagement may raise the forward surface of the locking mechanism above ramped projection 72, and thereby permit the locking mechanism to return toward its unlocked configuration.

In some embodiments, as optionally and schematically illustrated in FIG. 3, the locking mechanism 68 may include, may define, and/or may embody a bias mechanism, or spring, 69 that is configured to engage the body of the cap assembly and facilitate the locking mechanism disengaging and/or overcoming the structure 70 when a user selectively reconfigures the operational assembly from being locked in the open configuration to the closed configuration. For example, in the example of the structure 70 being one or more ramped projections 72, the bias mechanism may facilitate the locking mechanism rising above the ramped projections so that the operational assembly may return to the closed configuration via the optional bias of the operational assembly. In such embodiments, the engagement and/or friction between the locking mechanism and the ramped projections is greater than the bias or spring force of the bias mechanism, so that when a user selectively locks the operational assembly in the open configuration, the bias mechanism will not restrict or prevent the operational assembly from being temporarily locked. However, when a user, for example, engages the actuator 50 and translates it toward the body of the cap assembly, the spring force of the bias mechanism may be configured to cause the locking mechanism to automatically rise above the ramped projections, so that when the user releases the actuator, the locking mechanism will not restrict the operational assembly from returning to the closed configuration.

The locking mechanism (when present) may be integral to, and/or may cooperate with, outlet closure 46. Additionally or alternatively, the locking mechanism may be separate from the outlet closure. As an illustrative, non-exclusive example, the locking mechanism may be separately pivotal relative to the actuator, about the same pivotal axis about which the outlet closure is pivotally coupled to the actuator. Other configurations also are within the scope of the present disclosure.

In some embodiments, the cap assembly may further include an optional status indicator 74 that is configured to visually indicate to a user when the operational assembly is in the open configuration, when the operational assembly is optionally locked in the open configuration (in embodiments that include an optional locking mechanism 68), and/or when the operational assembly is in the closed configuration. Although not required, the optional status indicator may be associated with locking mechanism 68. For example, with reference to FIG. 3, the status indicator may not be visible to a user until such time that the locking mechanism has translated with the operational assembly to its open configuration. That is, the locking mechanism may cover, or otherwise hide or obscure from view, the status indicator when the operational assembly is in the closed configuration and may uncover, or otherwise reveal, the status indicator when the operational assembly is in the open configuration. Other configurations also are within the scope of the present disclosure, such as embodiments in which the outlet closure covers the status indicator when the operational assembly is in its closed configuration and uncovers the status indicator when the operational assembly is in its open configuration.

In some embodiments, the actuator may be described as being configured to be selectively pivoted relative to the body of the cap assembly among a range, or full range, of pivotal positions when the cap assembly is not coupled to the liquid container 12, with the actuator being restricted to only a subset of the range, or to less than the full range, of pivotal positions when the cap assembly is coupled to the liquid container. Such a configuration is schematically represented in FIG. 1, with the actuator 50 being illustrated in dash-dot lines in a position that overlaps the wall of the liquid container, and thus with this optional pivotal position of the actuator only being possible when the cap assembly is not coupled to the liquid container. In other words, in some embodiments, the liquid container may effectively stop or obstruct further pivotal movement of the actuator in the actuating direction, despite the actuator being configured to be pivoted further if the cap assembly were not coupled to the liquid container.

In some embodiments, in addition to a closed configuration 42 and an open configuration 44, the operational assembly 18 may be described as having a cleaning configuration 78 and/or as being operatively configurable to a cleaning configuration, as schematically represented in FIG. 1 in dash-dot and dash-dot-dot lines. To reconfigure the operational assembly to the cleaning configuration, the actuator may be engaged and actuated beyond the open configuration. For example, in embodiments in which the actuator is pivotal relative to the body of the cap assembly, the actuator may be pivoted past the point of the open configuration, with this optional position of the actuator illustrated in dash-dot lines in FIG. 1. Moreover, in embodiments of drink containers 10 in which the liquid container restricts the pivotal motion of the actuator to a subset of its full range of pivotal positions, the liquid container may serve to prevent the operational assembly from being configured to its cleaning configuration while the cap assembly is coupled to the liquid container. That is, in some embodiments, the operational assembly may be configured to the optional cleaning configuration only when the cap assembly has been decoupled from the liquid container.

In some embodiments in which the operational assembly has an optional cleaning configuration, the outlet closure 46 may be configured to be selectively pivoted away from the drink outlet 16 and relative to the body of the cap assembly when the operational assembly is in the cleaning configuration, such as schematically illustrated in dash-dot-dot lines in FIG. 1. Conversely, when the operational assembly is not in the cleaning configuration, such as when it is in the closed configuration, the open configuration, or between the open configuration and the closed configuration, the outlet closure may be restricted from being pivoted relative to the body of the cap assembly. Any suitable structure may accomplish this optional functionality. For example, the extent to which the distal end region projects through the outlet 16 may facilitate this functionality, in so far as the very distal end of the distal end region may engage the portion of the body of the cap assembly that defines the passage 34 and/or the outlet 16 when the operational assembly is in either of the closed configuration or the open configuration, thereby restricting pivotal movement of the outlet closure. Additionally or alternatively, other structure associated with the body, such as structure 54 or optional structure 56, may restrict pivotal movement of the outlet closure until the actuator has been actuated to an extent that the operational assembly reconfigures to the cleaning configuration. Other configurations also are within the scope of the present disclosure.

Turning now to FIGS. 4-19, an illustrative, non-exclusive example of a drink container 10, and component parts thereof, are illustrated. Where appropriate, the reference numerals from the schematic illustrations of FIGS. 1-3 are used to designate corresponding parts of this example; however, this example is non-exclusive and does not limit drink containers 10 to the illustrated embodiment of FIGS. 4-19. That is, drink containers 10 are not limited to the specific embodiment illustrated in FIGS. 4-19, and drink containers according to the present disclosure may incorporate any number of the various aspects, configurations, characteristics, properties, etc. that are illustrated in and discussed with reference to the schematic representations of FIGS. 1-3 and/or the embodiment of FIGS. 4-19, as well as variations thereof, without requiring the inclusion of all such aspects, configurations, characteristics, properties, etc. For the purpose of brevity, each previously discussed component, part, portion, aspect, region, etc. or variants thereof may not be discussed, illustrated, and/or labeled again with respect to the example of FIGS. 4-19; however, it is within the scope of the present disclosure that the previously discussed features, variants, etc. may be utilized with such example, or variations thereof.

The example drink container illustrated in FIGS. 4-19 is indicated generally at, and referred to herein as, drink container 100. Drink container 100 includes an illustrative, non-exclusive example of a liquid container 12, which is identified as a liquid container 102, and an illustrative, non-exclusive example of a cap assembly 14, which is identified as a cap assembly 104. Cap assembly 104 includes an illustrative, non-exclusive example of an operational assembly 18, which is identified as an operational assembly 108. Liquid container 102 is an example of a thermally-insulated liquid container having a double-walled construction, such as with space, or volume, 27 defined between the walls of the liquid container and with this space optionally filled with a solid insulating material. Accordingly, drink container 100 may be described as a thermally-insulated beverage container, or mug, and optionally may be referred to as a travel mug.

Figure 9:
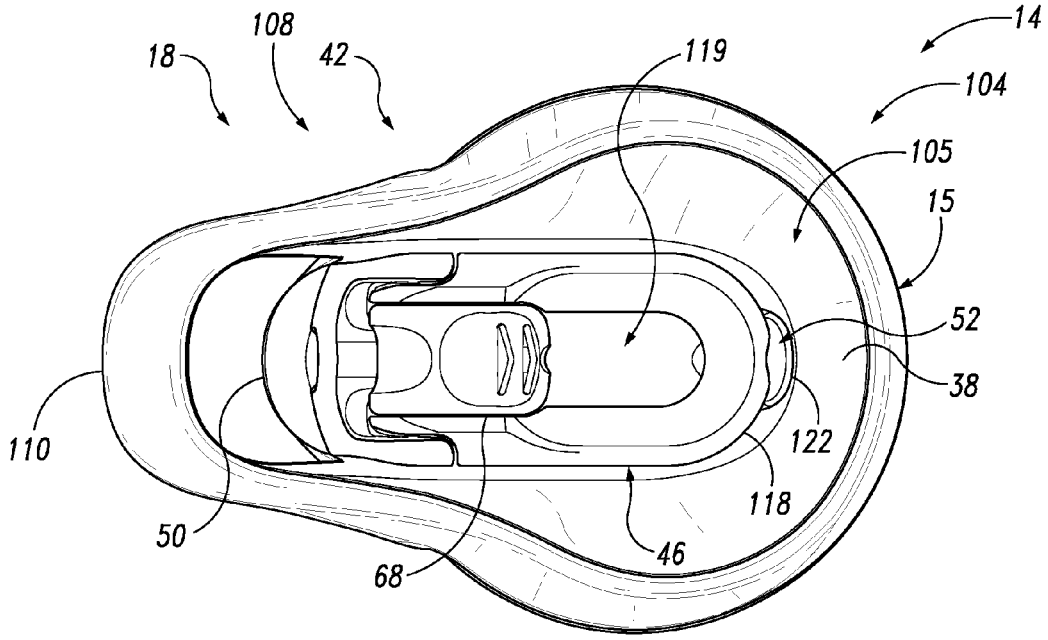
FIG. 9 is a top view of the cap assembly of the drink container of FIG. 4, with the cap assembly in the closed configuration.
Figure 10:
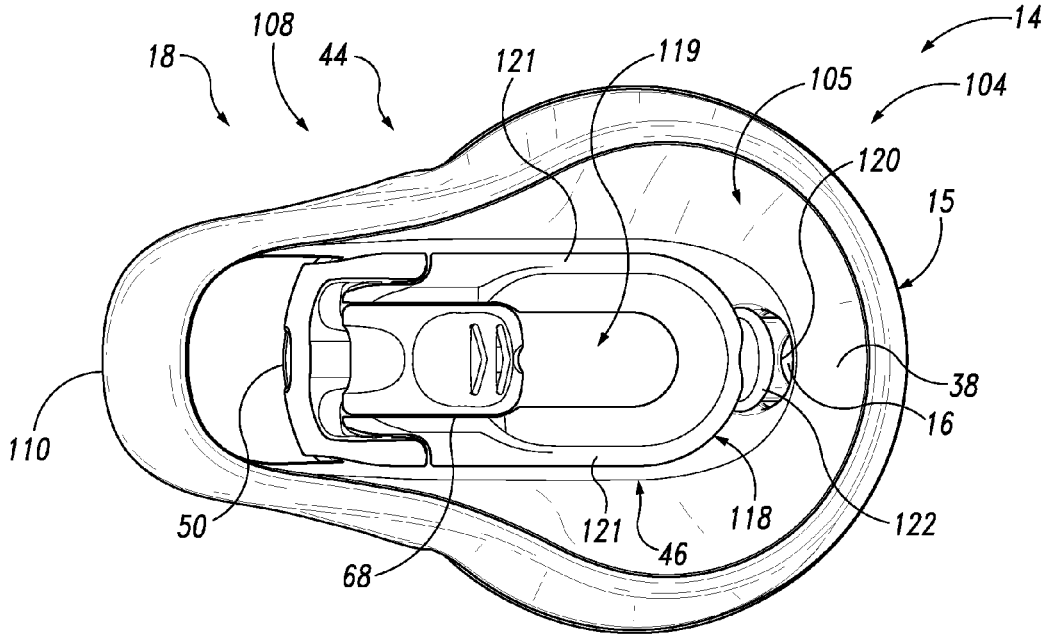
FIG. 10 is a top view of the cap assembly of the drink container of FIG. 4, with the cap assembly in the open configuration.

With reference first to the detailed views of cap assembly 104 in FIGS. 5-19, cap assembly 104 is an example of a cap assembly 14 that includes an operational assembly 18 (that is, operational assembly 108) that may be described as being predominantly positioned external of the body of the cap assembly. Moreover, operational assembly 108 is an example of an operational assembly that is configured to selectively seal the drink outlet from external the body of the cap assembly. More specifically, operational assembly 108 of cap assembly 104 is configured to selectively and operatively seal the drink outlet from a top side (i.e., upper surface) of the body of the cap assembly, as perhaps best seen with reference to FIGS. 9-10, with FIG. 9 illustrating the operational assembly in its closed configuration 42, and with FIG. 10 illustrating the operational assembly in its open, or drinking, configuration, for example, responsive to a user engaging the pivotal actuator 50 of the operational assembly. With reference to FIGS. 5-13, cap assembly 104 includes a body 15 that defines a drink outlet 16, a vent 40, and a drink spout 38. Cap assembly 104 includes an outlet closure 46, a vent closure 48, and, as mentioned, an operational assembly 108. The body 15 of cap assembly 104 also defines an optional handle 110. The body of cap assembly 104 includes an upper body 112 and a lower body 114, with the lower body 114 defining coupling structure 32 in the form of threads that mate with corresponding threads of the liquid container 102. Cap assembly 104 also includes a circular seal, or O-ring, 115 above the threads that services to improve a seal between the cap assembly with the drink container when operatively coupled together.

As perhaps best seen in FIGS. 5, 7, and 9-11, cap assembly 104 has a contoured and generally cup-shaped or bowl-shaped upper surface 105 that defines the drink spout 38. More specifically, drink outlet 16 extends through the upper surface 105 toward the front side of the cap assembly. Accordingly, when the operational assembly is selectively configured to the open configuration 44, as illustrated in FIG. 10, and when a user selectively tilts drink container 100 for consumption of drink liquid therefrom, drink liquid will exit the drink container via drink outlet 16 and pour across the bowl-shaped upper surface to the user's lips and/or mouth. As a result of this drink spout configuration, the drink liquid will be exposed to ambient air for a brief period of time as it flows across the upper surface 105 to the user's lips and/or mouth. The portion of the body against which a user's mouth and/or lips are in contact when the user drinks from the liquid container may be referred to as the lip engagement region and/or the mouth engagement region, which as discussed, is spaced apart from drink outlet 16. This configuration is distinct from thermally-insulated beverage containers that dispense hot liquid directly from an outlet into a user's mouth.

The outlet closure 46 of operational assembly 108 includes a body 118, a distal end region 52 that includes a tip 120, and an O-ring 122 positioned around the distal end region adjacent to the tip 120 and that is configured to seal the outlet 16 when the operational assembly is in the closed configuration 42, In this illustrative, non-exclusive configuration, tip 120 may define an optional recess, channel, passage, or other conduit through which drink fluid from the drink container may flow as the outlet closure is moved away from the closed configuration. As best seen in the exploded view of FIG. 13, this region takes the form of a semi-cylindrical void at the tip of the distal end region 52 of the outlet closure, although other configurations may be utilized. As discussed and/or illustrated herein, such a conduit may permit drink fluid to be dispensed through the drink outlet even when the entirety of the distal end region of the outlet closure has not been translated or otherwise withdrawn from the drink outlet.

As illustrated, body 118 of the outlet closure of operational assembly 108 includes a pair of members 121 that extends from, or proximate, actuator 50 generally toward distal end region 52 and defines an optional recess, channel, or space 119 between the members 121. Members 121 additionally or alternatively may be referred to as elongate members, spanning members, exterior members, and/or linkages. While not required to all embodiments, such a space may provide for additional clearance for a user's nose while the user is drinking from drink container 100. Body 118 optionally may include only a single member that extends generally between the actuator and distal end region 52 and/or may include more than a pair of spaced-apart members.

The cap assembly 104 further includes a U-shaped member 131 that generally extends around the actuator 50 and that provides an ergonomic feel for the actuator and the drink container as a whole when being held by a user. The U-shaped member is fixed relative to the body of the cap assembly with a pair of screws 133, and the actuator pivots relative to the U-shaped member. U-shaped member 131 additionally or alternatively may be described as a guard, or housing, for the actuator, as the member 131 restricts objects from lodging under the actuator (such as which may prevent use of the actuator) and/or to restrict unintentional actuation of the actuator, such as if the drink container tips over and the actuator contacts a hard surface.

Figure 13:
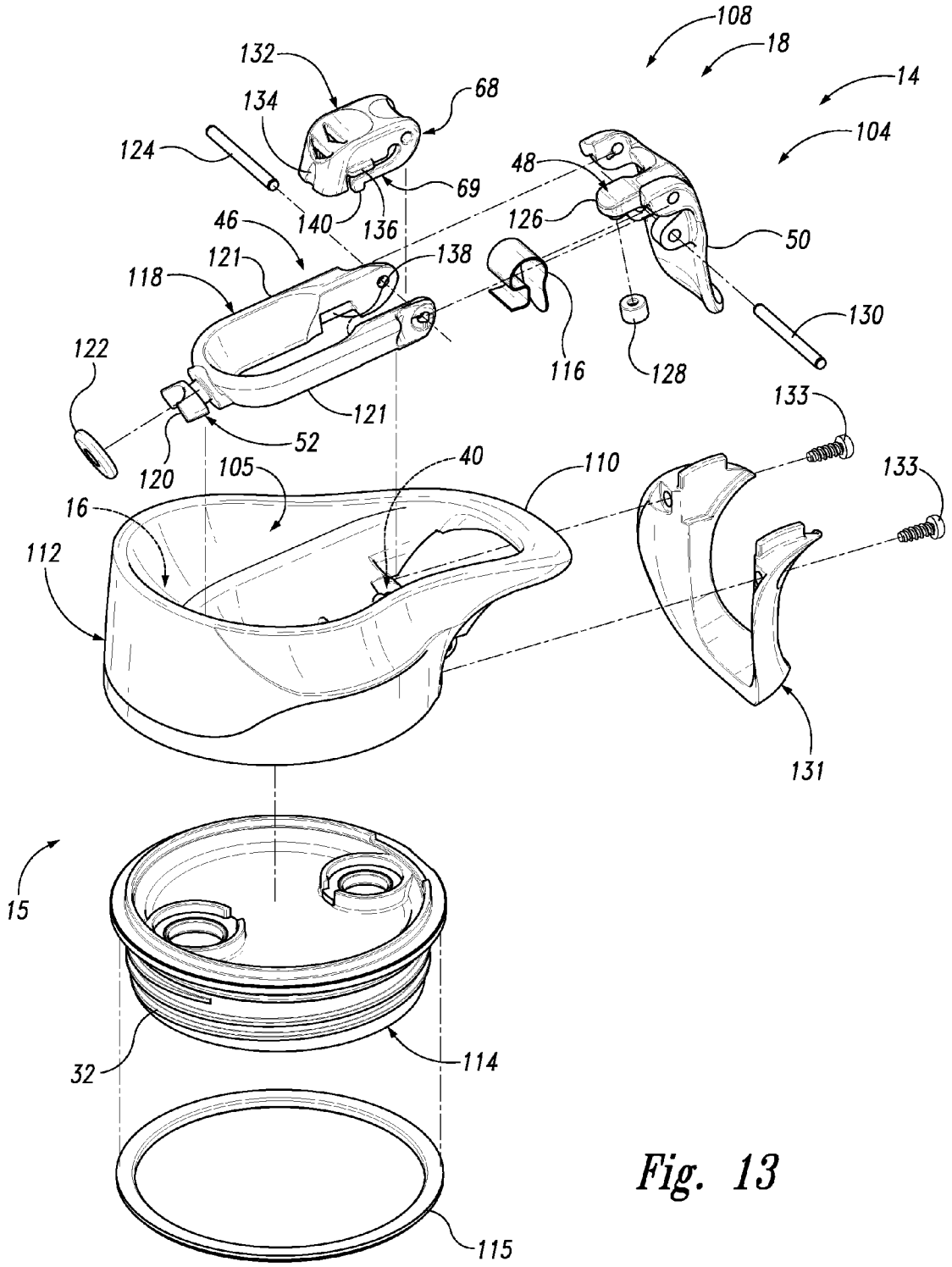
FIG. 13 is an exploded view of the cap assembly of the drink container of FIG. 4.

Turning now to the exploded view of FIG. 13 together with the cross-sectional views of FIGS. 14-18, operational assembly 108 includes a spring-biased actuator 50 in the form of a trigger that is pivotally coupled relative to the body of the cap assembly via a pin, or axle, 130. That is, the actuator 50 is configured to be selectively pivoted by a user toward the liquid container against the bias of a leaf spring 116 that biases the operational assembly to its closed configuration 42.

Figure 14:
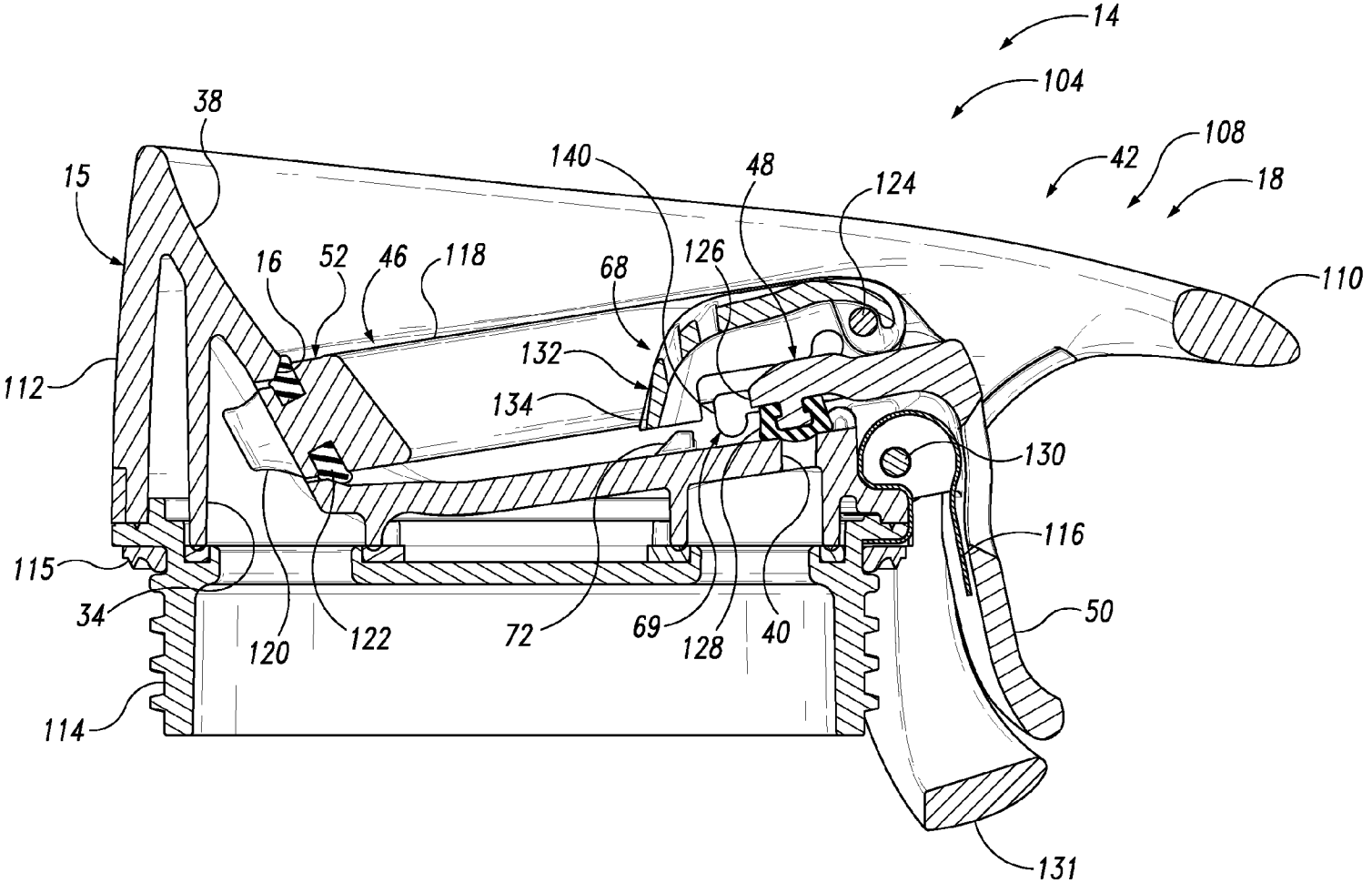
FIG. 14 is a left side cross-sectional view of the cap assembly of the drink container of FIG. 4, with the cap assembly in the closed configuration.
Figure 15:
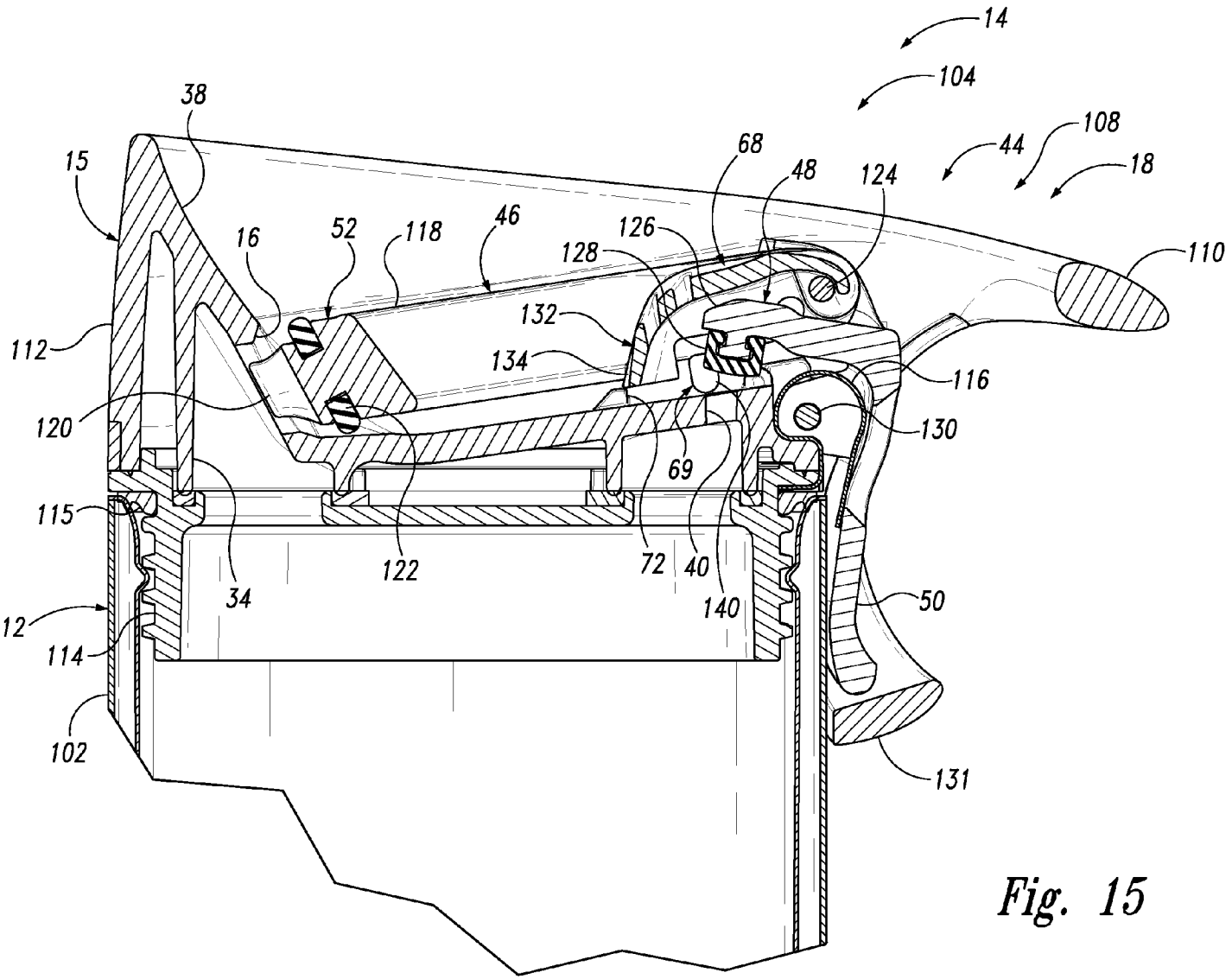
FIG. 15 is a fragmentary left side cross-sectional view of the drink container of FIG. 4, with the cap assembly in the open configuration.
Figure 17:
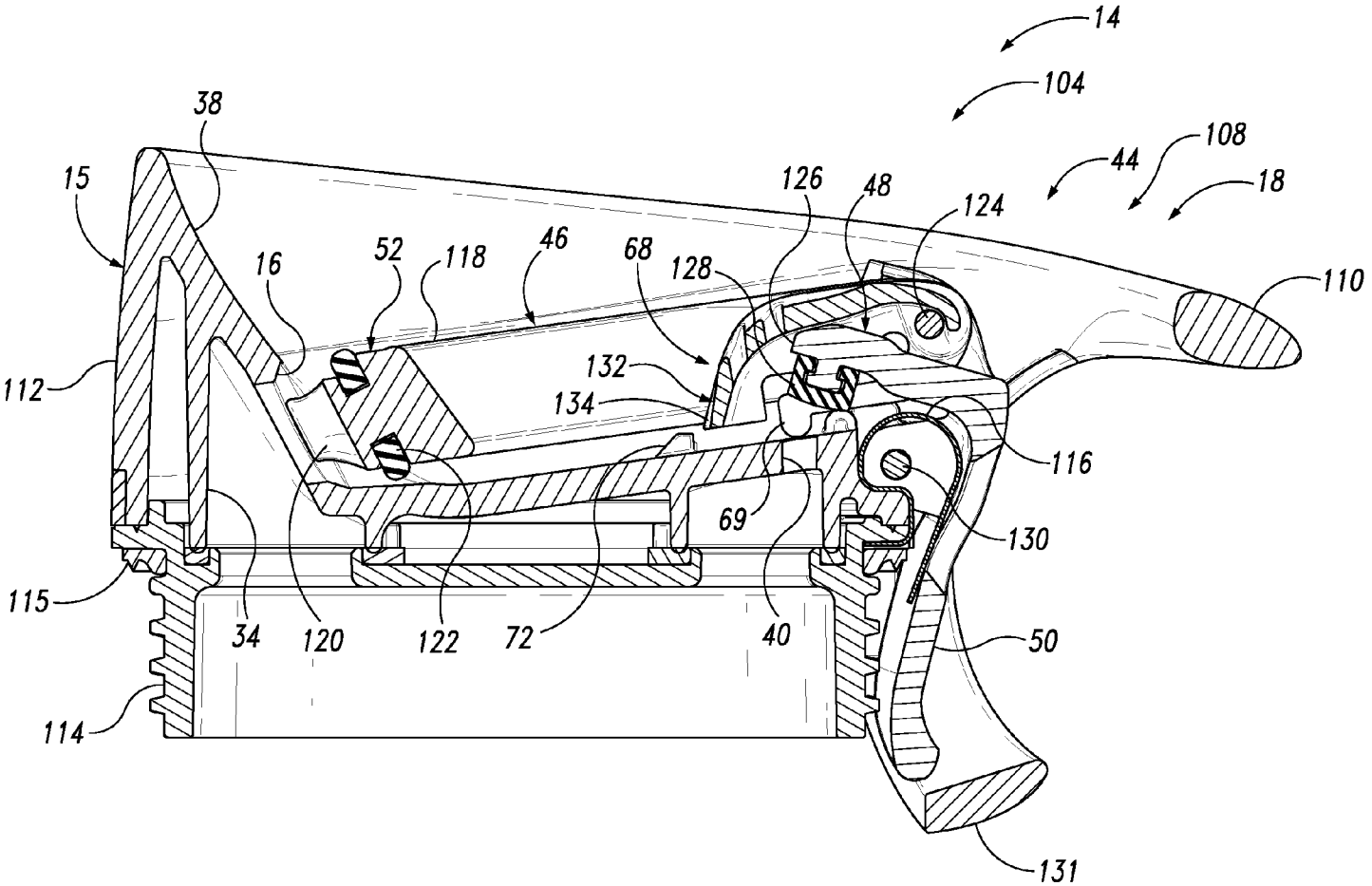
FIG. 17 is a left side cross-sectional view of the cap assembly of the drink container of FIG. 4, without the corresponding liquid container and with the actuator being positioned to permit reconfiguring of the operative assembly to the cleaning configuration.
Figure 18:
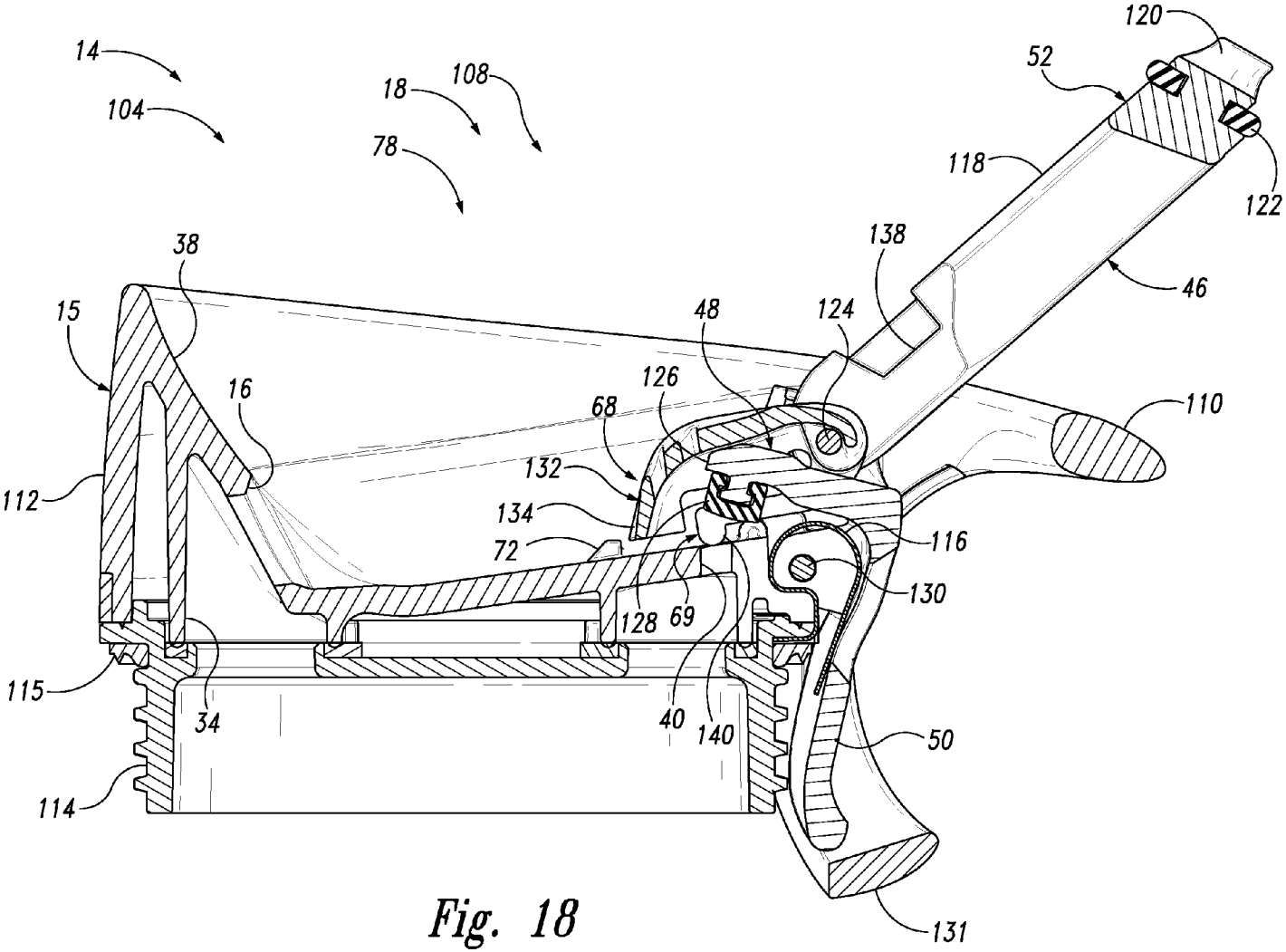
FIG. 18 is a left side cross-sectional view of the cap assembly of the drink container of FIG. 4, with the cap assembly in the cleaning configuration.
Figure 19:
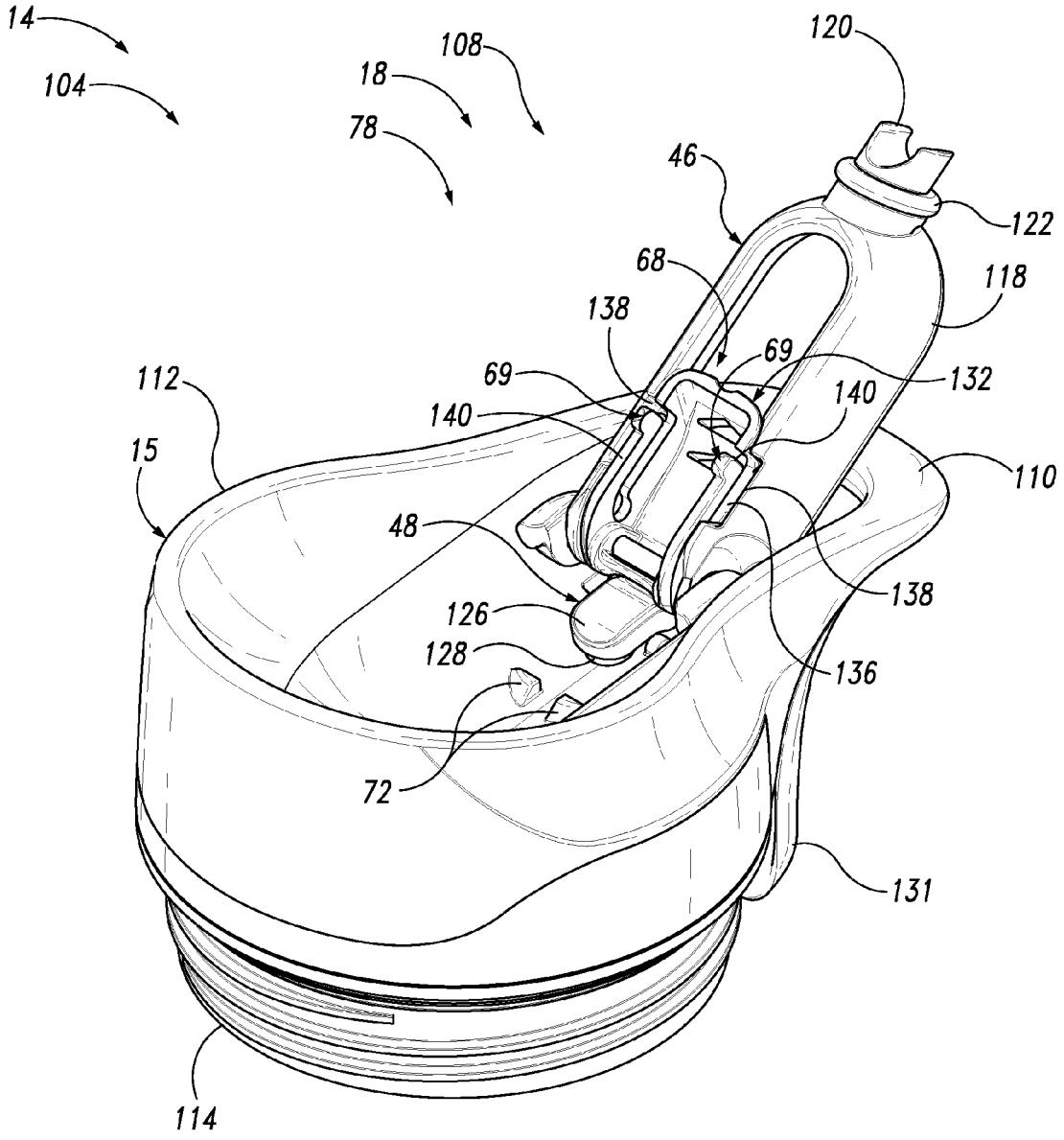
FIG. 19 is a perspective view of the cap assembly of the drink container of FIG. 4, with the cap assembly in the cleaning configuration.

The O-ring 122 seats against and seals the drink outlet 16 when the operational assembly is in the closed configuration, as illustrated in FIG. 14. When the operational assembly is reconfigured to the open, or drinking, configuration, as shown in FIG. 15, the tip 120 of the outlet closure is retracted only partially from the drink outlet, so that the semi-cylindrical void is in fluid communication with both the passage 34 and the environment external of the drink container. Accordingly, drink liquid may then be selectively dispensed through the drink outlet. However, the very distal tip of the distal tip region of the outlet closure remains extended at least partially through the outlet, optionally into engagement with the body of the cap assembly, and thereby restricts pivotal movement of the outlet closure relative to the body when the operational assembly is in the open configuration 44. However, when the cap assembly is removed from the liquid container, as illustrated in FIG. 17, the actuator may be further pivoted (i.e., beyond where the liquid container would have engaged the actuator) so that the tip 120 of the outlet closure is fully removed from the drink outlet, thereby permitting pivotal movement of the outlet closure relative to the body of the cap assembly, and thus permitting configuration of the operational assembly to the cleaning configuration 78, as illustrated in FIGS. 18-19, as well as in FIG. 11.

The body 118 of the outlet closure 46 of operational assembly 108 is rotationally coupled to the actuator 50, via a pin, or axle, 124, as seen in the exploded view of FIG. 13 and the cross-sectional views of FIGS. 14-18. This rotational coupling between the outlet closure and the actuator permits and/or provides for generally linear translation of the outlet closure when the operational assembly reconfigures between the closed configuration and the open configuration. The rotational coupling also permits the outlet closure to be pivoted away from the drink outlet and the body of the cap assembly when the operational assembly is configured to the cleaning configuration.

As mentioned, operational assembly 108 is an example of an operational assembly 18 that includes an optional vent closure 48. More specifically, as best seen with reference to the exploded view of FIG. 13 and in the cross-sectional views of FIGS. 14-18, the vent closure 48 includes a body 126 that is integral to the actuator 50 and a sealing member 128 (which may be formed from silicone or another suitable sealing material) that is positioned on the body 126 to selectively seal the vent 40. Accordingly, when the actuator is pivoted, the vent closure 48 automatically is pivoted relative to the vent and the sealing member 128 unseals the vent 40.

Figure 16:
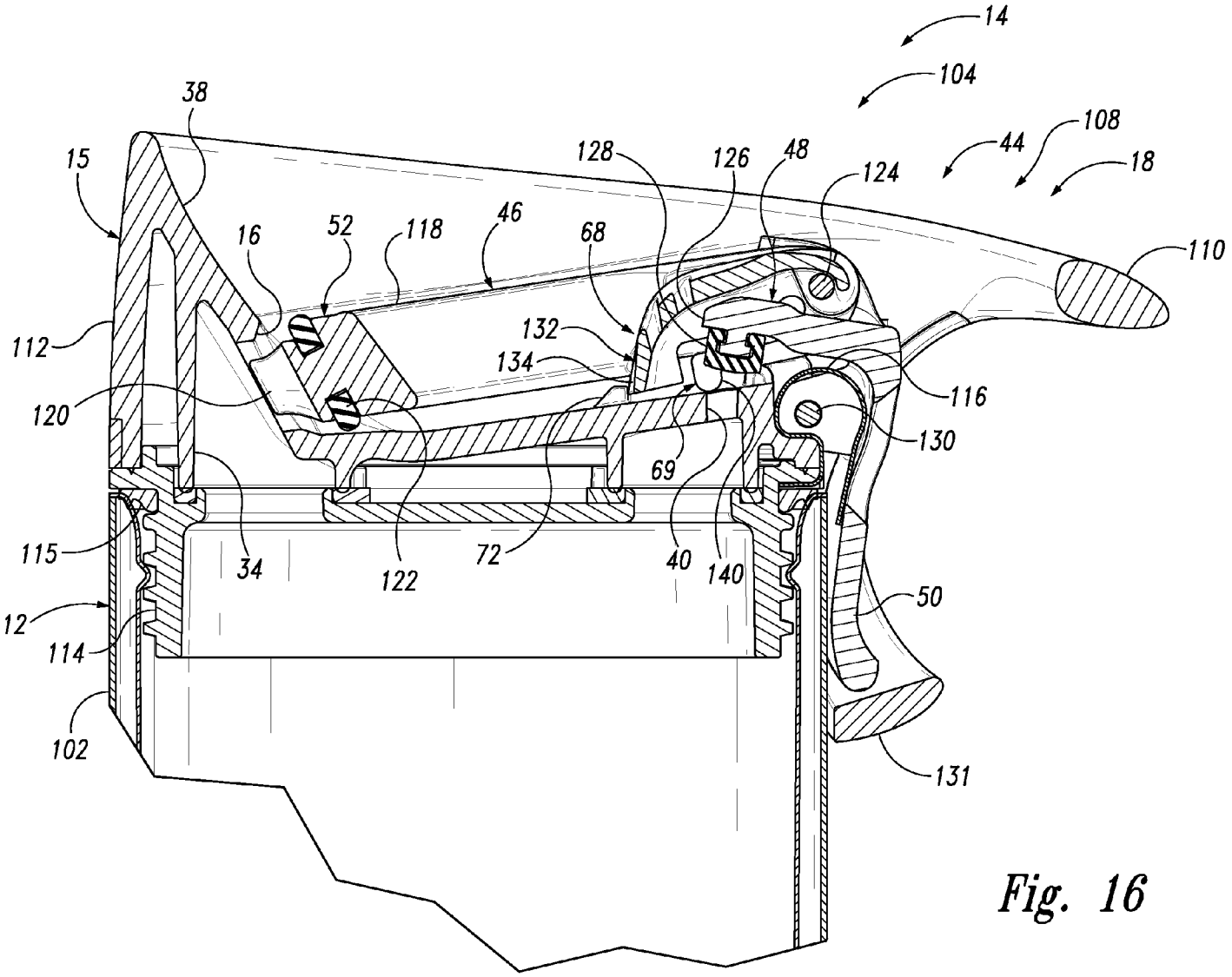
FIG. 16 is a fragmentary left side cross-sectional view of the drink container of FIG. 4, with the cap assembly in the locked-open configuration.

Cap assembly 104 also is an example of a cap assembly 14 that includes an optional locking mechanism 68. The locking mechanism 68 of cap assembly 104 includes a housing 132 that is pivotally coupled relative to the actuator via the pin 124, as best seen with reference to the exploded view of FIG. 13 and in the cross-sectional views of FIGS. 14-18. The upper body 112 of the cap assembly includes two ramped projections 72 that are configured to selectively engage an outer surface 134 of the housing 132 and thereby selectively retain the operational assembly 108 against the bias of spring 116. FIG. 15 illustrates the operational assembly in the open configuration without the housing 132 in a position to retain the operational assembly in the open configuration 44. FIG. 16, on the other hand, illustrates the operational assembly with the housing 132 having been pressed downward and engaged with ramped projections 72, thereby retaining the operational assembly in the open configuration, or locked-open configuration, against the bias of the spring 116, despite no actuation force being actively applied to the actuator by a user.

Figure 11:
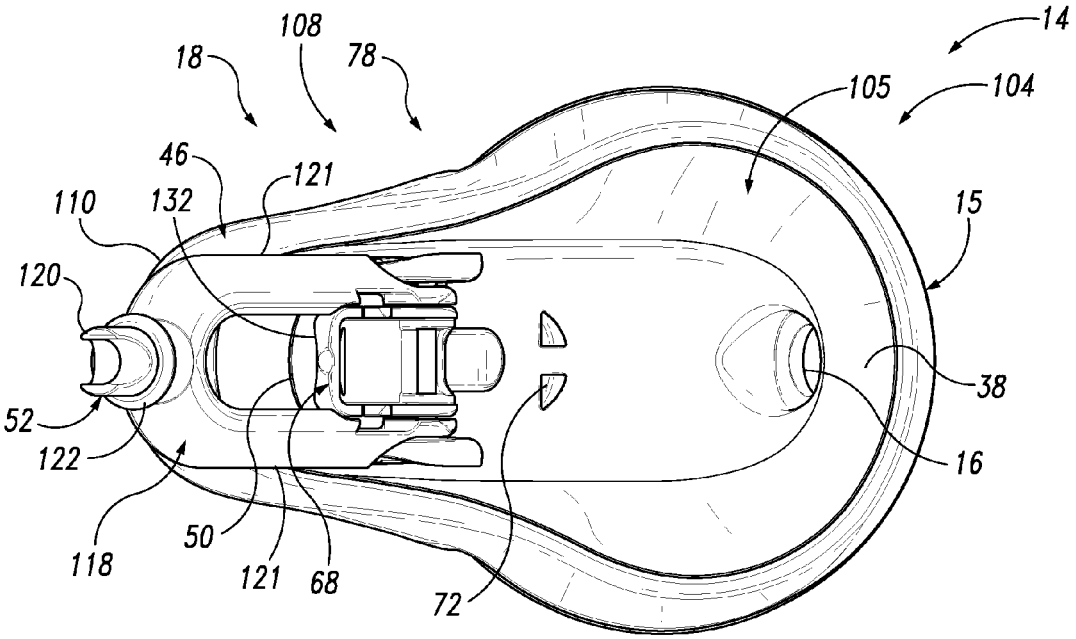
FIG. 11 is a top view of the cap assembly of the drink container of FIG. 4, with the cap assembly in the cleaning configuration.
Figure 12:
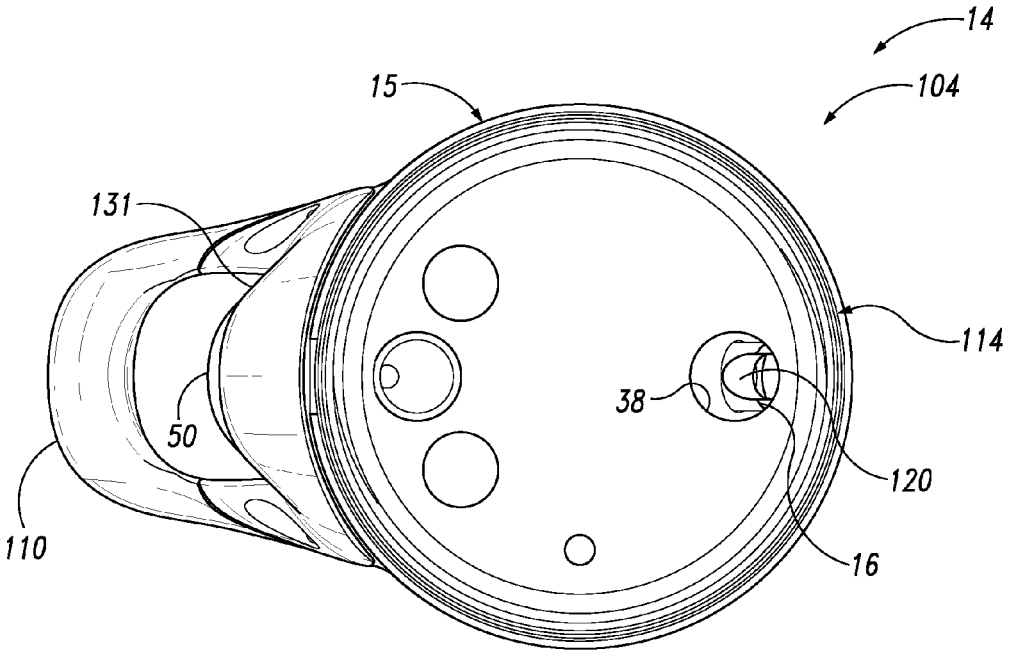
FIG. 12 is a bottom view of the cap assembly of the drink container of FIG. 4.

Housing 132 is positioned generally above and over the body 126 of the vent closure 48 of operational assembly 108. Accordingly, housing 132 may be described as serving more than one purpose. That is, the housing 132 serves as a locking mechanism 68, and it also serves to generally protect the vent closure when the operational assembly is in the open and closed configurations. While the housing may shield the vent closure from some physical contact, the housing optionally may be described as and/or referred to as a frame, or cage, as the housing may include openings, or vents, that permit (relatively) unobstructed flow through the upper surface of the housing of gas that is exhausted through the vent. Additionally or alternatively, the housing may be described as hollow and/or as defining a hollow volume. Because the housing 132 is pivotally attached to the actuator about pin 124, the housing may be pivoted away from the vent closure when the operational assembly is in the cleaning configuration, to permit cleaning around the vent and the vent closure, as illustrated in FIGS. 11 and 19.

Housing 132 is an example of a locking mechanism 68 that may be actuated in two ways to retain the operational assembly in the open configuration. First, a user may configure the operational assembly to the open configuration by exerting an external pivotal force on the actuator 50, and then the housing 132 may be pressed downward so that the surface 134 is positioned behind the ramped projections 72. Upon release of the actuator, the bias of the spring 116 will cause the surface 134 to engage the ramped projections, thereby restricting further translation of the housing, and thus further pivotal movement of the actuator back toward the closed configuration. Alternatively, a user may engage the housing 132 directly and exert a force directed generally toward the actuator 50 and the handle 110 of the cap assembly (i.e., away from the drink outlet), causing the housing to slide along/across the upper surface of the body and over the ramped projections until the surface 134 is operatively retained behind the ramped projections.

The housing 132 also optionally includes two laterally extending tabs 136 that engage corresponding ledges 138 defined by the outlet closure, as perhaps best seen with reference to FIG. 19. Accordingly, the housing 132 is restricted from pivoting relative to the body of the cap assembly about the pin 124 until the outlet closure 46 is first pivoted about the pin 124, such as when the operational assembly is configured to the cleaning configuration.

The locking mechanism 68 of cap assembly 104 also is an example of a locking mechanism that includes a spring 69 that is configured to engage the body of the cap assembly and facilitate the selective disengagement of the housing 132 from the ramped projections 72 in response to a user further actuating the actuator when the operational assembly is in the locked-open configuration. As perhaps best seen in the exploded view of FIG. 13 and with reference to the cross-sectional views of FIGS. 15-16, the spring 69 is defined by a pair of leaf spring members 140 that extend from the pivot axis of the housing 132, with the leaf spring members 140 including downward projecting distal end regions that engage an upper surface of the body of the cap assembly when the housing is operatively and selectively positioned behind the ramped projections. Accordingly, when the operational assembly is in the locked-open configuration and when a user then selectively further actuates the actuator, thereby sliding the housing rearward of the ramped projections, the spring 69 will cause the housing to pivot up slightly, so that when the user selectively releases the actuator, the locking mechanism will permit the operational assembly to return to the closed configuration as a result of the bias of the spring 116.

Illustrative, non-exclusive examples of drink containers and cap assemblies according to the present disclosure are described in the following enumerated paragraphs:

A. A drink container, comprising:

a liquid container having a neck with an opening and having an internal compartment sized to hold a volume of potable drink liquid; and a cap assembly removably coupled to the liquid container, the cap assembly comprising:

a body, the body defining a drink outlet through which drink liquid may be selectively dispensed to a user; and an operational assembly operatively coupled to the body, the operational assembly having a closed configuration and an open configuration and including:

an outlet closure configured to restrict drink liquid from exiting the liquid container via the drink outlet when the operational assembly is in the closed configuration and to permit drink liquid to exit the liquid container via the drink outlet when the operational assembly is in the open configuration; and an actuator configured to be selectively engaged by a user to selectively reconfigure the operational assembly from the closed configuration to the open configuration.

A1. The drink container of paragraph A, wherein the body of the cap assembly further defines a vent through which gas may be selectively released from the internal compartment of the liquid container, and wherein the operational assembly further includes:

a vent closure configured to restrict gas from entering and exiting the liquid container via the vent when the operational assembly is in the closed configuration and to permit gas to enter and exit the liquid container via the vent when the operational assembly is in the open configuration.

A1.1. The drink container of paragraph A1, wherein the vent closure is configured to pivot when the operational assembly reconfigures between the closed configuration and the open configuration.

A1.2. The drink container of any of paragraphs A1-A1.1, wherein the operational assembly is configured such that selective actuation of the actuator to reconfigure the operational assembly from the closed configuration to the open configuration results in the outlet closure permitting drink liquid to exit the liquid container via the drink outlet simultaneously (or optionally nearly simultaneously) with the vent closure permitting gas to enter and exit the liquid container via the vent.

A1.3. The drink container of any of paragraphs A1-A1.1, wherein the operational assembly is configured such that selective actuation of the actuator to reconfigure the operational assembly from the closed configuration to the open configuration results in the vent closure permitting gas to enter and exit the liquid container via the vent at a moment in time prior to the outlet closure permitting drink liquid to exit the liquid container via the drink outlet.

A2. The drink container of any of paragraphs A-A1.3, wherein the operational assembly is biased toward the closed configuration.

A3. The drink container of any of paragraphs A-A2, wherein the body of the cap assembly has a lower side that generally faces the internal compartment of the liquid container when the cap assembly is coupled to the liquid container and an upper side that generally faces away from the internal compartment of the liquid container when the cap assembly is coupled to the liquid container.

A3.1. The drink container of paragraph A3, wherein the outlet closure is positioned on the upper side of the body.

A3.2. The drink container of any of paragraphs A3-A3.1 when depending from paragraph A1, wherein the vent closure is positioned on the upper side of the body.

A4. The drink container of any of paragraphs A-A3.2, wherein the outlet closure is positioned at least predominantly on an external surface of the body of the cap assembly.

A5. The drink container of any of paragraphs A-A4, wherein the operational assembly is predominantly positioned external of the body of the cap assembly when the cap assembly is coupled to the liquid container.

A6. The drink container of any of paragraphs A-A5, wherein the outlet closure is configured to translate generally linearly (and optionally linearly) when the operational assembly reconfigures between the closed configuration and the open configuration.

A7. The drink container of any of paragraphs A-A6, wherein the actuator is configured to be selectively pivoted relative to the body of the cap assembly to reconfigure the operational assembly from the closed configuration to the open configuration.

A7.1. The drink container of paragraph A7, wherein the actuator is configured to be selectively pivoted relative to the body of the cap assembly among a range of pivotal positions when the cap assembly is not coupled to the liquid container, and wherein the actuator is restricted to a subset of the range of pivotal positions when the cap assembly is coupled to the liquid container.

A8. The drink container of any of paragraphs A-A7.1, wherein the operational assembly is configured to be selectively and temporarily retained in the open configuration without requiring maintained actuation of the actuator by a user.

A9. The drink container of any of paragraphs A-A8, wherein the operational assembly further includes a lock-open feature configured to facilitate selective and temporary retention of the operational assembly in the open configuration.

A10. The drink container of any of paragraphs A-A9, wherein the operational assembly further includes:

a locking mechanism (optionally a button) configured to be selectively engaged by a user to selectively and temporarily retain the operational assembly in the open configuration.

A10.1. The drink container of paragraph A10, wherein the body includes structure configured to cooperate with the locking mechanism to selectively and temporarily retain the operational assembly in the open configuration.

A10.1.1. The drink container of paragraph A10.1, wherein the locking mechanism includes a housing, and wherein the structure configured to cooperate with the locking mechanism to selectively and temporarily retain the operational assembly in the open configuration includes one or more ramped projections, and wherein the housing is configured to be selectively retained against the ramped projections when the operational assembly is locked in the open configuration.

A10.1.1.1. The drink container of paragraph A10.1.1, wherein the housing defines a spring that engages the body of the cap assembly and that is configured to bias the housing away from the body of the cap assembly when a user selectively releases the locking mechanism so that the operational assembly returns to the closed configuration.

A10.2. The drink container of any of paragraphs A10-A10.1.1.1, wherein the locking mechanism is configured to permit the operational assembly to return to the closed configuration upon a user selectively actuating the actuator.

A11. The drink container of any of paragraphs A-A10.2, wherein the cap assembly further includes a status indicator configured to visually indicate to a user when the operational assembly is in the open configuration.

A12. The drink container of any of paragraphs A-A11, wherein the operational assembly further has a cleaning configuration, and wherein the actuator is further configured to be selectively engaged by a user to selectively reconfigure the operational assembly to the cleaning configuration.

A12.1. The drink container of paragraph A12, wherein in the cleaning configuration, the outlet closure is configured to be selectively pivoted away from the drink outlet.

A12.2. The drink container of any of paragraphs A12-A12.1, wherein the operational assembly is restricted from being reconfigured to the cleaning configuration when the cap assembly is coupled to the liquid container.

A12.3. The drink container of any of paragraphs A12-A12.2, when depending from paragraph A10, wherein when the operational assembly is in the cleaning configuration, the locking mechanism is configured to be selectively pivoted relative to the body of the cap assembly.

A13. The drink container of any of paragraphs A-A12.3, wherein the outlet closure includes a pair of members that extends from proximate the actuator to a distal tip of the outlet closure and along an upper side of the body when the operational assembly is in the closed configuration and when the operational assembly is in the open configuration.

A13.1. The drink container of paragraph A13, wherein the pair of members defines a space between the members that is sized to receive at least a portion of a user's nose when the user is drinking from the drink container.

A14. The drink container of any of paragraphs A-A13.1, wherein the body of the cap assembly has an upper side that is generally bowl-shaped.

A14.1. The drink container of paragraph A14, wherein the upper side defines a drink spout from the drink outlet to a lip engagement region of the body, wherein the drink spout is positioned and sized to expose drink liquid to ambient air when drink liquid is dispensed from the drink outlet to a user's lips that are engaged with the lip engagement region.

B. A drink container, comprising:

a liquid container having a neck with an opening and having an internal compartment sized to hold a volume of potable drink liquid; and a cap assembly removably coupled to the liquid container, the cap assembly comprising:

a body, the body defining a drink outlet through which drink liquid may be selectively dispensed to a user; and an operational assembly operatively coupled to the body and predominantly positioned external of the body when the cap assembly is coupled to the liquid container, the operational assembly having a closed configuration in which drink liquid is restricted from exiting the internal compartment via the drink outlet, an open configuration in which drink liquid is permitted to exit the internal compartment via the drink outlet, and a cleaning configuration, wherein the operational assembly includes:

an actuator configured to be selectively engaged by a user to selectively reconfigure the operational assembly from the closed configuration to the open configuration; and an outlet closure operatively coupled to the actuator and configured to be selectively translated laterally across the body of the cap assembly responsive to user engagement of the actuator, to restrict drink liquid from exiting the liquid container via the drink outlet when the operational assembly is in the closed configuration, to permit drink liquid to exit the liquid container via the drink outlet when the operational assembly is in the open configuration, and to be selectively pivoted relative to the body of the cap assembly to reconfigure the operational assembly to the cleaning configuration.

B1. The drink container of paragraph B, wherein the operational assembly is restricted from being reconfigured to the cleaning configuration when the cap assembly is coupled to the liquid container.

B1.1. The drink container of paragraph B1, wherein the actuator is configured to be selectively pivoted relative to the body of the cap assembly among a range of pivotal positions, wherein the actuator is restricted to a subset of the range of pivotal positions when the cap assembly is coupled to the liquid container, and wherein the operational assembly is restricted from being reconfigured to the cleaning configuration when the actuator is positioned within the subset of the range of pivotal positions.

B2. The drink container of any of paragraphs B-B1.1, wherein the outlet closure is positioned generally on an upper side of the body of the cap assembly when the operational assembly is in the closed configuration and when the operational assembly is in the open configuration, wherein the outlet closure includes a distal end region that extends into and plugs the drink outlet when the operational assembly is in the closed configuration and is retracted at least partially from the drink outlet when the operational assembly is in the open configuration.

B3. The drink container of any of paragraphs B-B2, wherein the body of the cap assembly defines a generally bowl-shaped upper surface and a lip engagement region, wherein the upper surface defines a drink spout from the drink outlet to the lip engagement region, and wherein the drink spout is positioned and sized to expose drink liquid to ambient air when drink liquid is dispensed from the drink outlet to a user's lips that are engaged with the lip engagement region.

B4. The drink container of any of paragraphs B-B3, wherein the outlet closure includes a pair of members that extends from proximate the actuator to a distal tip of the outlet closure and along an upper side of the body of the cap assembly when the operational assembly is in the closed configuration and when the operational assembly is in the open configuration, and wherein the pair of members defines a space between the members that is sized to receive at least a portion of a user's nose when the user is drinking from the drink container.

B5. The drink container of any of paragraphs B-B4, wherein the body of the cap assembly further defines a vent through which gas may be selectively released from the internal compartment of the liquid container, and wherein the operational assembly further includes:

a vent closure configured to restrict gas from entering and exiting the liquid container via the vent when the operational assembly is in the closed configuration and to permit gas to enter and exit the liquid container via the vent when the operational assembly is in the open configuration, wherein the vent closure is configured to pivot when the operational assembly reconfigures between the closed configuration and the open configuration.

B5.1. The drink container of paragraph B5, wherein the operational assembly is configured such that selective actuation of the actuator to reconfigure the operational assembly from the closed configuration to the open configuration results in the outlet closure permitting drink liquid to exit the liquid container via the drink outlet simultaneously with the vent closure permitting gas to enter and exit the liquid container via the vent.

B6. The drink container of any of paragraphs B-B5.1, wherein the operational assembly is biased toward the closed configuration from the open configuration.

B7. The drink container of any of paragraphs B-B6, wherein the operational assembly is configured to be selectively and temporarily retained in the open configuration without requiring maintained actuation of the actuator by a user.

B8. The drink container of any of paragraphs B-B7, wherein the operational assembly further includes a locking mechanism that includes a housing configured to be selectively engaged by a user to selectively and temporarily retain the operational assembly in the open configuration; and wherein the body includes one or more ramped projections configured to cooperate with the locking mechanism to selectively and temporarily retain the operational assembly in the open configuration, and wherein the housing is configured to be selectively retained against the one or more ramped projections when the operational assembly is locked in the open configuration.

B8.1. The drink container of paragraph B8, wherein the housing defines a spring that engages the body of the cap assembly and that is configured to bias the housing away from the body of the cap assembly when a user selectively releases the locking mechanism so that the operational assembly returns to the closed configuration.

B8.2. The drink container of any of paragraphs B8-B8.1, wherein the locking mechanism is configured to permit the operational assembly to return to the closed configuration upon a user selectively actuating the actuator.

B8.3. The drink container of any of paragraphs B8-B8.2, wherein the body of the cap assembly further defines a vent through which gas may be selectively released from the internal compartment of the liquid container; and wherein the housing of the locking mechanism extends over the vent.

B8.3.1. The drink container of paragraph B8.3, wherein the operational assembly further includes:

a vent closure configured to restrict gas from entering and exiting the liquid container via the vent when the operational assembly is in the closed configuration and to permit gas to enter and exit the liquid container via the vent when the operational assembly is in the open configuration, wherein the vent closure is configured to pivot when the operational assembly reconfigures between the closed configuration and the open configuration; and wherein the housing of the locking mechanism extends over the vent closure.

C. A drink container, comprising:

a liquid container having a neck with an opening and having an internal compartment sized to hold a volume of potable drink liquid; and a cap assembly removably coupled to the liquid container, the cap assembly comprising:

a body, the body defining a drink outlet through which drink liquid may be selectively dispensed to a user; and an operational assembly operatively coupled to the body and predominantly positioned external of the body when the cap assembly is coupled to the liquid container, the operational assembly having a closed configuration in which drink liquid is restricted from exiting the internal compartment via the drink outlet, and an open configuration in which drink liquid is permitted to exit the internal compartment via the drink outlet, wherein the operational assembly includes:

an actuator configured to be selectively engaged by a user to selectively reconfigure the operational assembly from the closed configuration to the open configuration; and an outlet closure positioned generally on an upper side of the body of the cap assembly and operatively coupled to the actuator, wherein the outlet closure includes a distal end region that extends into and plugs the drink outlet when the operational assembly is in the closed position to restrict drink liquid from exiting the liquid container via the drink outlet and that is retracted at least partially from the drink outlet when the operational assembly is in the open configuration to permit drink liquid to exit the liquid container via the drink outlet, wherein the outlet closure is configured to be selectively translated laterally across the body of the cap assembly responsive to user engagement of the actuator, wherein the outlet closure includes a pair of spaced-apart members that extend from proximate the actuator to the distal end region and along the upper side of the body of the cap assembly.

C1. The drink container of paragraph C, wherein the pair of members defines a space between the members that is sized to receive at least a portion of a user's nose when the user is drinking from the drink container.

C2. The drink container of any of paragraphs C-C1, wherein the body of the cap assembly defines a generally bowl-shaped upper surface and a lip engagement region, wherein the upper surface defines a drink spout from the drink outlet to the lip engagement region, and wherein the drink spout is positioned and sized to expose drink liquid to ambient air when drink liquid is dispensed from the drink outlet to a user's lips that are engaged with the lip engagement region.

C3. The drink container of any of paragraphs C-C2, wherein the operational assembly is configured to be selectively and temporarily retained in the open configuration without requiring maintained actuation of the actuator by a user.

D. A drink container, comprising:

a liquid container having a neck with an opening and having an internal compartment sized to hold a volume of potable drink liquid; and a cap assembly removably coupled to the liquid container, the cap assembly comprising:

a body, the body the defining a drink outlet through which drink liquid may be selectively dispensed to a user; and an operational assembly, wherein the operational assembly includes means for selective reconfiguration of the operational assembly between (i) a closed configuration in which drink liquid is restricted from exiting the internal compartment via the drink outlet, (ii) an open configuration in which drink liquid is permitted to exit the internal compartment via the drink outlet, and (iii) a cleaning configuration in which portions of the operational assembly are spaced away from the body of the cap assembly.

E. A drink container, comprising:

a liquid container having a neck with an opening and having an internal compartment sized to hold a volume of potable drink liquid; and a cap assembly removably coupled to the liquid container, the cap assembly comprising:

a body, the body defining a drink outlet through which drink liquid may be selectively dispensed to a user; and an operational assembly, wherein the operational assembly includes an outlet closure with a distal end region that selectively prevents drink liquid from exiting the liquid container via the drink outlet, and further wherein the operational assembly includes means for selective reconfiguration of the operational assembly between (i) a closed configuration in which the outlet closure prevents drink liquid from exiting the internal compartment via the drink outlet, (ii) an open configuration in which the outlet closure is translated from the closed configuration and permits drink fluid to exit the internal compartment via the drink outlet, and (iii) a cleaning configuration in which the outlet closure is pivoted away from the body of the cap assembly.

F. A cap assembly, comprising the cap assembly as described in any of paragraphs A-E, separate from a liquid container, wherein the cap assembly is configured to be removably coupled to a liquid container.

G. The use of the drink container and/or the cap assembly of any of paragraphs A-F.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It also is within the scope of the present disclosure that elements, components, and/or other recited subject matter that is recited as being adapted to perform a particular function may additionally or alternatively be described as being configured to perform that function, and vice versa.

As used herein, "selective" and "selectively," when modifying an action, movement, configuration, or other activity of one or more components or characteristics of a drink container according to the present disclosure, means that the specified action, movement, configuration, or other activity is a direct or indirect result of user manipulation of an aspect of, or one or more components of, the drink container.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A drink container, comprising:

a liquid container having a neck with an opening and having an internal compartment sized to hold a volume of potable drink liquid; and a cap assembly removably coupled to the liquid container, the cap assembly comprising:

a body, the body defining a drink outlet through which drink liquid may be selectively dispensed to a user; and an operational assembly operatively coupled to the body and predominantly positioned external of the body when the cap assembly is coupled to the liquid container, the operational assembly having a closed configuration in which drink liquid is restricted from exiting the internal compartment via the drink outlet, an open configuration in which drink liquid is permitted to exit the internal compartment via the drink outlet, and a cleaning configuration, wherein the operational assembly is coupled to the body in the open configuration, the closed configuration, and the cleaning configuration, wherein the operational assembly includes:

an actuator configured to be selectively engaged by a user to selectively reconfigure the operational assembly from the closed configuration to the open configuration; and an outlet closure operatively coupled to the actuator and configured to be selectively translated relative to the body of the cap assembly responsive to user engagement of the actuator, to restrict drink liquid from exiting the liquid container via the drink outlet when the operational assembly is in the closed configuration, to permit drink liquid to exit the liquid container via the drink outlet when the operational assembly is in the open configuration, and to be selectively pivoted relative to the body of the cap assembly, and away from the drink outlet to reconfigure the operational assembly to the cleaning configuration.

2. The drink container of claim 1, wherein the body has an upper surface that is external to the internal compartment when the cap assembly is coupled to the liquid container, and further wherein the outlet closure is coupled to the actuator by at least one elongate member that extends along the upper surface when the operational assembly is in the open configuration and when the operational assembly is in the closed configuration.

3. The drink container of claim 1, wherein the operational assembly is restricted from being reconfigured to the cleaning configuration when the cap assembly is coupled to the liquid container.

4. The drink container of claim 3, wherein the actuator is configured to be selectively pivoted relative to the body of the cap assembly among a range of pivotal positions, wherein the actuator is restricted to a subset of the range of pivotal positions when the cap assembly is coupled to the liquid container, and wherein the operational assembly is restricted from being reconfigured to the cleaning configuration when the actuator is positioned within the subset of the range of pivotal positions.

5. The drink container of claim 1, wherein the outlet closure is positioned generally on an upper side of the body of the cap assembly when the operational assembly is in the closed configuration and when the operational assembly is in the open configuration, wherein the outlet closure includes a distal end region that extends into and plugs the drink outlet when the operational assembly is in the closed configuration and is retracted at least partially from the drink outlet when the operational assembly is in the open configuration.

6. The drink container of claim 5, wherein when the cap assembly is coupled to the liquid container, the outlet closure is restricted from being removed entirely from the drink outlet responsive to user engagement of the actuator.

7. The drink container of claim 6, wherein restriction of the outlet closure from being removed entirely from the drink outlet restricts the operational assembly from being configured to the cleaning configuration responsive to user engagement of the actuator.

8. The drink container of claim 1, wherein the body of the cap assembly defines a generally bowl-shaped upper surface and a mouth engagement region, wherein the upper surface defines a drink spout from the drink outlet to the mouth engagement region, and wherein the drink spout is positioned and sized to expose drink liquid to ambient air when drink liquid is dispensed from the drink outlet to a user's mouth that is engaged with the mouth engagement region.

9. The drink container of claim 1, wherein the outlet closure includes a pair of members that extends from proximate the actuator to a distal tip of the outlet closure and along an upper side of the body of the cap assembly when the operational assembly is in the closed configuration and when the operational assembly is in the open configuration, and wherein the pair of members defines a space between the members that is sized to receive at least a portion of a user's nose when the user is drinking from the drink container.

10. The drink container of claim 1, wherein the body of the cap assembly further defines a vent through which gas may be selectively released from the internal compartment of the liquid container, and wherein the operational assembly further includes:

a vent closure configured to restrict gas from entering and exiting the liquid container via the vent when the operational assembly is in the closed configuration and to permit gas to enter and exit the liquid container via the vent when the operational assembly is in the open configuration, wherein the vent closure is configured to pivot when the operational assembly reconfigures between the closed configuration and the open configuration.

11. The drink container of claim 10, wherein the operational assembly is configured such that selective actuation of the actuator to reconfigure the operational assembly from the closed configuration to the open configuration results in the outlet closure permitting drink liquid to exit the liquid container via the drink outlet simultaneously with the vent closure permitting gas to enter and exit the liquid container via the vent.

12. The drink container of claim 1, wherein the operational assembly is biased toward the closed configuration from the open configuration.

13. The drink container of claim 1, wherein the operational assembly is configured to be selectively and temporarily retained in the open configuration without requiring maintained actuation of the actuator by a user.

14. The drink container of claim 1, wherein the operational assembly further includes a locking mechanism that includes a housing configured to be selectively engaged by a user to selectively and temporarily retain the operational assembly in the open configuration; and wherein the body includes a projection configured to cooperate with the locking mechanism to selectively and temporarily retain the operational assembly in the open configuration, and wherein the housing is configured to be selectively retained against the projection when the operational assembly is locked in the open configuration.

15. The drink container of claim 14, wherein the projection is a ramped projection that extends at an angle away from the drink outlet, and further wherein the operational assembly is configured to be reconfigured from the closed configuration to the open configuration and retained in the open configuration by the locking mechanism responsive to a user urging the housing away from the drink outlet and over the ramped projection.

16. The drink container of claim 14, wherein the housing defines a spring that engages the body of the cap assembly and that is configured to bias the housing away from the body of the cap assembly when a user selectively releases the locking mechanism so that the operational assembly returns to the closed configuration.

17. The drink container of claim 14, wherein the locking mechanism is configured to permit the operational assembly to return to the closed configuration upon a user selectively actuating the actuator.

18. The drink container of claim 14, wherein the body of the cap assembly further defines a vent through which gas may be selectively released from the internal compartment of the liquid container; and wherein the housing of the locking mechanism extends over the vent.

19. The drink container of claim 18, wherein the operational assembly further includes:

a vent closure configured to restrict gas from entering and exiting the liquid container via the vent when the operational assembly is in the closed configuration and to permit gas to enter and exit the liquid container via the vent when the operational assembly is in the open configuration, wherein the vent closure is configured to pivot when the operational assembly reconfigures between the closed configuration and the open configuration; and wherein the housing of the locking mechanism extends over the vent closure.

20. A drink container, comprising:

a liquid container having a neck with an opening and having an internal compartment sized to hold a volume of potable drink liquid; and a cap assembly removably coupled to the liquid container, the cap assembly comprising:

a body, the body defining a drink outlet through which drink liquid may be selectively dispensed to a user; and an operational assembly operatively coupled to the body and predominantly positioned external of the body when the cap assembly is coupled to the liquid container, the operational assembly having a closed configuration in which drink liquid is restricted from exiting the internal compartment via the drink outlet, and an open configuration in which drink liquid is permitted to exit the internal compartment via the drink outlet, wherein the operational assembly includes:

an actuator configured to be selectively engaged by a user to selectively reconfigure the operational assembly from the closed configuration to the open configuration; and an outlet closure positioned generally on an upper side of the body of the cap assembly and operatively coupled to the actuator, wherein the outlet closure includes a distal end region that extends into and plugs the drink outlet when the operational assembly is in the closed configuration to restrict drink liquid from exiting the liquid container via the drink outlet and that is retracted at least partially from the drink outlet when the operational assembly is in the open configuration to permit drink liquid to exit the liquid container via the drink outlet, wherein the outlet closure is configured to be selectively translated laterally across the body of the cap assembly responsive to user engagement of the actuator, wherein the outlet closure includes a pair of spaced-apart members that extend from proximate the actuator to the distal end region and along the upper side of the body of the cap assembly.

21. The drink container of claim 20, wherein the pair of members defines a space between the members that is sized to receive at least a portion of a user's nose when the user is drinking from the drink container.

22. The drink container of claim 20, wherein the body of the cap assembly defines a generally bowl-shaped upper surface and a mouth engagement region, wherein the upper surface defines a drink spout from the drink outlet to the mouth engagement region, and wherein the drink spout is positioned and sized to expose drink liquid to ambient air when drink liquid is dispensed from the drink outlet to a user's mouth that is engaged with the mouth engagement region.

23. The drink container of claim 20, wherein the operational assembly is configured to be selectively and temporarily retained in the open configuration without requiring maintained actuation of the actuator by a user.

24. A drink container, comprising:

a liquid container having a neck with an opening and having an internal compartment sized to hold a volume of potable drink liquid; and a cap assembly removably coupled to the liquid container, the cap assembly comprising:

a body, the body defining a drink outlet through which drink liquid may be selectively dispensed to a user; and an operational assembly, wherein the operational assembly includes an outlet closure with a distal end region that selectively prevents drink liquid from exiting the liquid container via the drink outlet, and further wherein the operational assembly includes means for selective reconfiguration of the operational assembly between (i) a closed configuration in which the outlet closure prevents drink liquid from exiting the internal compartment via the drink outlet, (ii) an open configuration in which the outlet closure is translated from the closed configuration and permits drink fluid to exit the internal compartment via the drink outlet, and (iii) a cleaning configuration in which the outlet closure is pivoted away from the body of the cap assembly; wherein the operational assembly is coupled to the body in the open configuration, the closed configuration, and the cleaning configuration.

25. The drink container of claim 1, wherein the outlet closure is configured to selectively seal the drink outlet from external the body of the cap assembly.

26. The drink container of claim 2, wherein the elongate member is connected to the actuator by a first pin, and further wherein the actuator is connected to the body of the cap assembly by a second pin that is spaced apart from the first pin.

27. The drink container of claim 20, wherein the outlet closure is configured to selectively seal the drink outlet from external the body of the cap assembly.

28. The drink container of claim 20, wherein the pair of members are connected to the actuator by a first pin, and further wherein the actuator is connected to the body of the cap assembly by a second pin that is spaced apart from the first pin.

29. The drink container of claim 20, wherein the outlet closure is further configured to be pivoted relative to the body of the cap assembly, and away from the drink outlet to reconfigure the operational assembly to a cleaning configuration, and further wherein the operational assembly is coupled to the body in the open configuration, the closed configuration, and the cleaning configuration.

30. The drink container of claim 29, wherein the operational assembly is restricted from being reconfigured to the cleaning configuration when the cap assembly is coupled to the liquid container.

31. The drink container of claim 30, wherein the actuator is configured to be selectively pivoted relative to the body of the cap assembly among a range of pivotal positions, wherein the actuator is restricted to a subset of the range of pivotal positions when the cap assembly is coupled to the liquid container, and wherein the operational assembly is restricted from being reconfigured to the cleaning configuration when the actuator is positioned within the subset of the range of pivotal positions.

32. The drink container of claim 29, wherein when the cap assembly is coupled to the liquid container, the outlet closure is restricted from being removed entirely from the drink outlet responsive to user engagement of the actuator.

33. The drink container of claim 32, wherein restriction of the outlet closure from being removed entirely from the drink outlet restricts the operational assembly from being configured to the cleaning configuration responsive to user engagement of the actuator.

34. The drink container of claim 24, wherein the outlet closure is configured to selectively seal the drink outlet from external the body of the cap assembly.

35. The drink container of claim 24, wherein the operational assembly is restricted from being reconfigured to the cleaning configuration when the cap assembly is coupled to the liquid container.

36. The drink container of claim 35, wherein the means for selective reconfiguration of the operational assembly includes an actuator configured to be selectively engaged by a user to selectively reconfigure the operational assembly between the open configuration, the closed configuration, and the cleaning configuration, wherein the actuator is configured to be selectively pivoted relative to the body of the cap assembly among a range of pivotal positions, wherein the actuator is restricted to a subset of the range of pivotal positions when the cap assembly is coupled to the liquid container, and wherein the operational assembly is restricted from being reconfigured to the cleaning configuration when the actuator is positioned within the subset of the range of pivotal positions.

37. The drink container of claim 36, wherein when the cap assembly is coupled to the liquid container, the outlet closure is restricted from being removed entirely from the drink outlet responsive to user engagement of the actuator.

38. The drink container of claim 37, wherein restriction of the outlet closure from being removed entirely from the drink outlet restricts the operational assembly from being configured to the cleaning configuration responsive to user engagement of the actuator.

39. The drink container of claim 24, wherein the outlet closure is positioned generally on an upper side of the body of the cap assembly when the operational assembly is in the closed configuration and when the operational assembly is in the open configuration, wherein the outlet closure includes a distal end region that extends into and plugs the drink outlet when the operational assembly is in the closed configuration and is retracted at least partially from the drink outlet when the operational assembly is in the open configuration.

* * * * *